United States Patent [19]

Swisher, Jr. et al.

[11] 3,997,277

[45] Dec. 14, 1976

[54] MATERIAL TRANSFER MECHANISM

[75] Inventors: George W. Swisher, Jr., Oklahoma City; Don W. Smith, Edmond; Gary L. Westphall, Oklahoma City, all of Okla.

[73] Assignee: CMI Corporation, Oklahoma City, Okla.

[22] Filed: June 13, 1975

[21] Appl. No.: 586,576

[52] U.S. Cl. ..... 404/84

[51] Int. Cl.[2] ..... E01C 19/00

[58] Field of Search ..... 404/84, 108, 101; 60/445

[56] References Cited

UNITED STATES PATENTS

| | | | |
|---|---|---|---|
| 2,591,502 | 4/1952 | Bohannan | 404/84 |
| 3,453,939 | 7/1969 | Pollitz | 404/84 |
| 3,537,363 | 11/1970 | Long | 404/108 X |
| 3,678,817 | 7/1972 | Martenson | 404/84 X |
| 3,774,401 | 11/1973 | Allen | 404/84 X |
| R25,275 | 10/1962 | Pollitz | 404/84 |

*Primary Examiner*—Nile C. Byers, Jr.
*Attorney, Agent, or Firm*—Dunlap, Codding and McCarthy

[57] ABSTRACT

An improved material transfer mechanism comprising a selectively variable speed hydraulic power assembly having an output connected to and powering a material conveyor. A double acting hydraulic ram positions a swash plate control lever that determines the rotational speed of the output shaft, and a hydraulic porting valve assembly is disposed to actuate the hydraulic ram, the hydraulic porting valve assembly comprising a pivotally supported valve body having an internally disposed fluid control means, the fluid control means being variably displaced in the valve body by the actuation of a pressure controlling mechanism for the purpose of selectively determining and establishing fluid communication of a source of hydraulic pressure fluid to alternate ends of the hydraulic ram with the hydraulic porting valve assembly to selectively control the hydraulic ram. The valve body is biased in a first pivotal direction and is movable in a second pivotal direction by a feed back linkage cable interconnecting the valve body and the swash plate control lever. A sensor mechanism detects the material transferred by the material conveyor and responsively positions the pressure controlling mechanism independently to the position of the valve body.

32 Claims, 21 Drawing Figures

MATERIAL TRANSFER MECHANISM

BACKGROUND OF THE INVENTION

1. Field of the Invention

The present invention relates generally to material handling mechanisms whereby transfer of a material is effected from a transferring station to a receiving station, the rate of material transfer being responsive to a detected parameter at the receiving station, and more particularly, but not by way of limitation, to an improved paving material distribution system in combination with a paving machine used for paving a continuous lane along a roadway.

2. Description of the Prior Art

Traditionally, pavers laying bituminous material or the like operated by first laying the paving material on a prepared roadway, and then compressing the paving material by the use of a heavy roller. In recent years, machines have been developed that spread the material along the roadway and then provide a preliminary compression of the material with compression equipment mounted on or behind the spreader apparatus. Machines of this type are taught, for example, in the patents issued to Pollitz, U.S. Pat. No. 2,757,588; Bohannan, U.S. Pat. No. 2,591,502; and Pollitz, U.S. Pat. No. 2,911,892.

Further refinement has been brought about by the use of means to control a compressing screed that is pulled behind the powered spreading portion of the paving machine. For example, reference may be made to the patents issued to Shea, U.S. Pat. No. 3,264,959; Shea, U.S. Pat. No. 3,029,716; and Ackerman, et al, U.S. Pat. No. 3,236,163.

A recurring problem with the referenced types of paving machines has been that of spreading the paving material in a controlled and regulated manner. That is, paving machines of the type referenced generally have a hopper device near the front of the machine that receives paving material from a delivery truck or the like. A transfer mechanism, usually a slat conveyor, moves the material rearwardly where a screw conveyor spreads the paving material transversely to the roadway being paved, directly in front of a compressing screed. Since the quality of the compressed mat or lane is dependent on several factors, among which is the amount of paving material delivered immediately in front of the screed, it has been determined that the paving operation is highly improved by the maintenance of a constant volume of paving material in front of the screed.

To understand the reason for this, one must understand the action of the floating screed, which is a heavy planar member pulled over the transversely spread paving material. The screed is pulled against a mound of paving material that is continually formed by the deposited material in the path of the screed; the weight of the compressing screed is counteracted by the mound of paving material exerting back pressure on the screed which causes the screed to attempt to rise. If the amount of the material varies in front of the screed, the back pressure on the screed will vary, and the screed will alternately rise and fall, leaving in its wake a wavy and, often times, unacceptable paved surface. During the paving of even very smooth roadway bed surfaces, the maintenance of a constant screed back pressure is difficult because slight irregularities in the grade are reflected in the responsive movement of the screed. Such irregularities result in undulations in the finished pavement surface. It will be appreciated that when the grade is highly irregular, the paving machine operator has a very great problem in controlling the paving material feeding mechanism in a manner that effectuates a constant volume of paving material in front of the screed in order to achieve a uniform screed back pressure. This is true because the depressions encountered in the grade must be filled while high spots in the grade require less material, resulting in a variable amount of paving material required to form the mound in front of the screed. It should be readily appreciated that the skill of the paving operator is a very important consideration when paving with bituminous material or the like over irregular grade.

The Pollitz patent, U.S. Pat. No. 2,911,892, teaches the use of a screw conveyor in order to spread the paving material across the roadway in front of the screed, and this patent teaches the use of a sensor arm that contacts the outer edge of the material deposited by the screw conveyor in front of the screed. An off-on switch is controllably actuated by the position of the movable sensor arm, causing the clutch of the spreading screw conveyor to disengage in order to stop the rotation of the screw conveyor when sufficient material is sensed at the outer edge of the deposited material. The patent to Martinson, U.S. Pat. No. 3,678,817, teaches a further improvement in that the sensing paddle contacting the outer edge of the deposited material is part of a proportional control electrical circuit whereby the amount of material delivered to the sides of the machine is proportional to the amount of material required to supply the demand under the screed to effectuate constant back pressure. That is, the position of the sensing paddle generates a signal to control the rate of flow of the material delivered in front of the screed by the conveyors. A potentiometer is responsive to the position of the sensor paddle, thereby providing a variable electrical signal.

The present invention presents a further improvement over the prior art devices, in that a direct linkage, proportional control system is disclosed and claimed. By the use of direct mechanical linkages and rugged hydraulic valving, the present invention provides an improved material transfer mechanism that is useful in combination with a continuous paving machine to effectuate constant screed back pressure, resulting in the production of a superior paved surface when the paving machine is operated over variable grade roadbed surfaces.

SUMMARY OF THE INVENTION

It is an object of the present invention to provide an improved material transfer mechanism for the control of material transfer responsive to a detected control dimension parameter.

It is another object of the present invention to provide an improved material transfer mechanism that operates in a rugged environment, as for example, on a continuous laydown paving machine for the control of paving material deposition to effect constant screed back pressure in the compression of the deposited material for the purpose of forming a paved lane or the like.

It is yet another object of the present invention to provide an improved transfer mechanism that operates efficiently, is easily manufacturable, and has extended life usefulness, requiring a minimum of repair and upkeep.

Other objects and advantages of the present invention will be apparent to one having ordinary skill in the art when considering the following detailed disclosure taken in conjunction with the drawings and the appended claims.

DESCRIPTION OF THE PREFERRED EMBODIMENT

Figure 1:
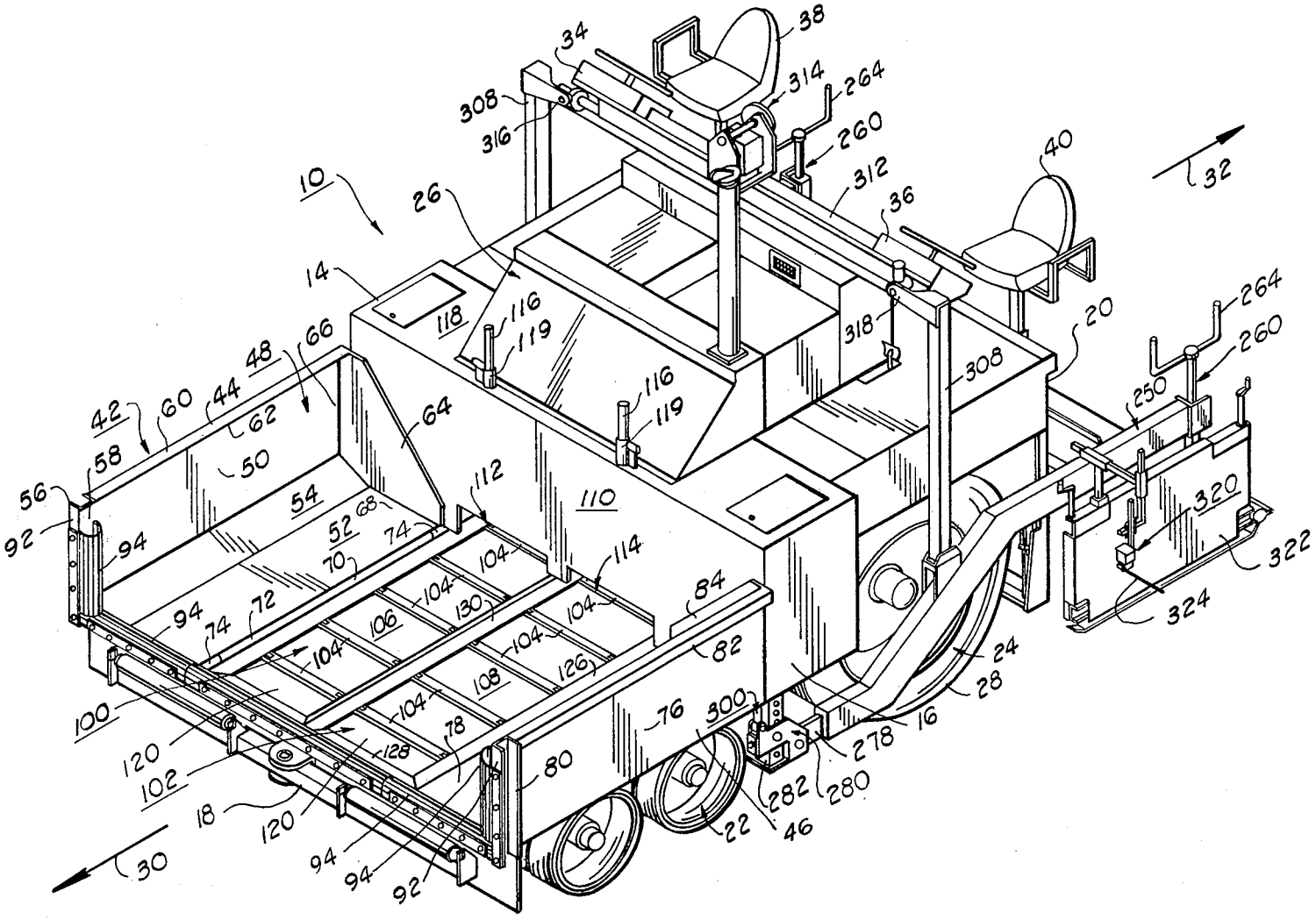
FIG. 1 is an isometric view of a continuous laydown paving machine embodying the present invention.
Figure 2:
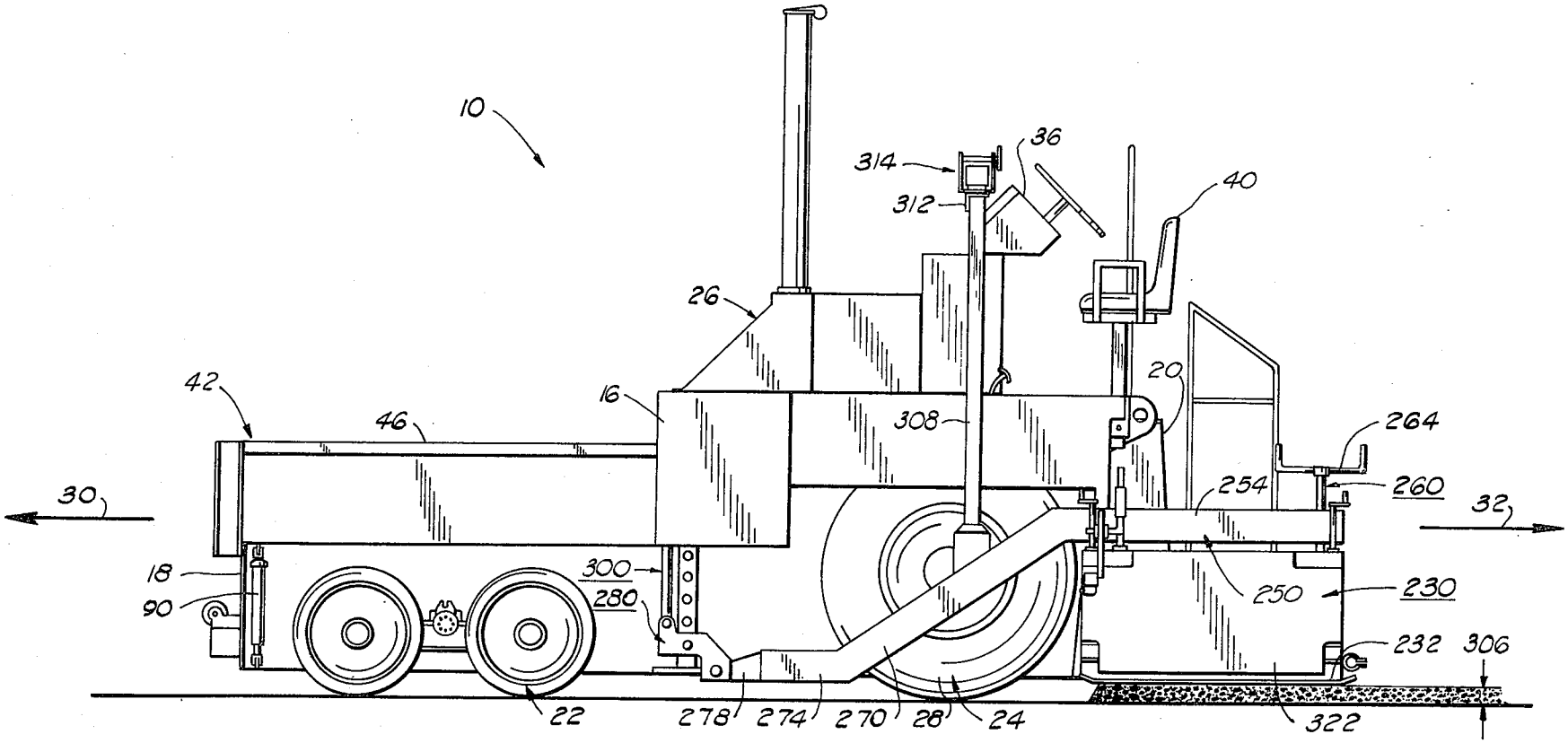
FIG. 2 is a side elevational view of the paving machine of FIG. 1.

Referring to the drawings in general, and specifically to FIGS. 1 and 2, shown therein is a continuous laydown paving machine 10 embodying the present invention. For purposes of clarity, like numerals will be used throughout the various drawings included herewith to depict the same components appearing in the different views presented. Also, the various drawings will not reflect the details of various electrical and hydraulic circuitry, such details being unnecessary for the understanding of the disclosed invention.

The paving machine 10, also referred to as a road building machine herein, has a frame assembly 12 that has a right side 14, a left side 16, a front end 18, and a rear end 20. As used in the present disclosure, a reference to right or left is made with the perspective of the operator position in mind, the right side 14 of the paving machine 10 being on the operator's righthand side. The frame assembly 12 is movably supported by the front suspension and steering assembly 22, and a rear suspension assembly 24. These suspension assemblies will be described in more detail below, and it is sufficient here to state that the frame assembly 12 is supported and steered by the front suspension steering assembly 22, and the frame assembly 12 is supported, driven and braked by the rear suspension assembly 24.

A conventional power plant (not shown) is supported by the frame assembly 12 and located in the engine compartment 26. The power plant is used in a conventional manner to drivingly power the rear wheels 28 of the rear suspension assembly 24 to motorize the frame assembly 12 along a selected path in a forward direction 30, which is the direction of travel during paving, or in a rearward direction 32 as may be required for purposes of manuevering. A right operator console 34 and a left operator console 36 are provided, and the operator supports 38, 40 are provided respectively near the operator consoles 34, 36 for the purpose of providing the operator of the paving machine 10 the best possible vantage point during paving operations, it being the designed goal of permitting an operator a choice of driving positions. As will become clear below, steering of the paving machine 10 is accomplished by the controlled pivotation of the front suspension and steering assembly 22, the actuation of which may be operator or stringline controlled.

Supported at the front end 18 of the frame assembly 12 is a hopper assembly 42 that serves to receive paving material from a dump truck or the like during paving operations. The hopper assembly 42 is comprised of a first hopper member 44 and a second hopper member 46 that together define a material receiving cavity 48. The first hopper member 44 has an outer wall 50, and a floor member 52, these members being planar and joined such as by welding to form a generally L-shaped first hopper member 44, as is made clear by referring to FIG. 3A, a semi-detailed view of the hopper assembly 42 as viewed from the front end 18 of the paving machine 10. A corner member 54 is welded to the outer wall 50 and the floor 52 to provide a fillet corner as shown in FIG. 1.

A support beam 56 is welded as a strengthening member along the end 58 of the outer wall 50, and a roll flange member 60 is welded on the top edge 62 of the outer wall 50. A cross brace member 64 is welded to the distal end 66 of the outer wall 50 and to the distal end 68 of the floor member 52 in order to form an end wall and to strengthen the first hopper member 44. Other strengthening members may be added to the first hopper member 44 as may be required.

Attached along the edge 70 of the floor member 52 is a hinge cylinder member 72 that serves as a hinge bearing for the first hopper member 44. Located in pivotal support relation to, and at each end of, the hinge cylinder member 72 is a hopper pin 74. Each of the hopper pins 74 has a pintle arbor (not shown) that is received into one of the hollow ends of the hinge cylinder member 72, and each hopper pin 74 is attached to the frame assembly 12. The hinge connection created by the hinge cylinder member 72 and the two hopper pins 74 serves to mount the first hopper member 44 for pivotation relative to the frame assembly 12.

The second hopper member 46 is similar in construction to the first hopper member 44, and in light of the above detailed description of the first hopper member 44, it will not be necessary for purposes of this disclosure to provide further description, with the exception of stating that the second hopper member 46 has an outer wall 76, a floor member 78, a corner member (not shown), a support beam 80, a roll flange member 82, and a cross brace member 84, and these components are joined to form a generally L-shaped member in like manner to that described for the first hopper member 44. The second hopper member 46 is pivotally connected to the frame assembly 12 by a hinge cylinder and hopper pin arrangement which, although not shown, is similar in construction to that described above. As shown in FIG. 1, the first and second hopper members 44, 46 are disposed in an opposingly facing manner so as to define a material receiving cavity 48 therebetween.

Figure 3A:
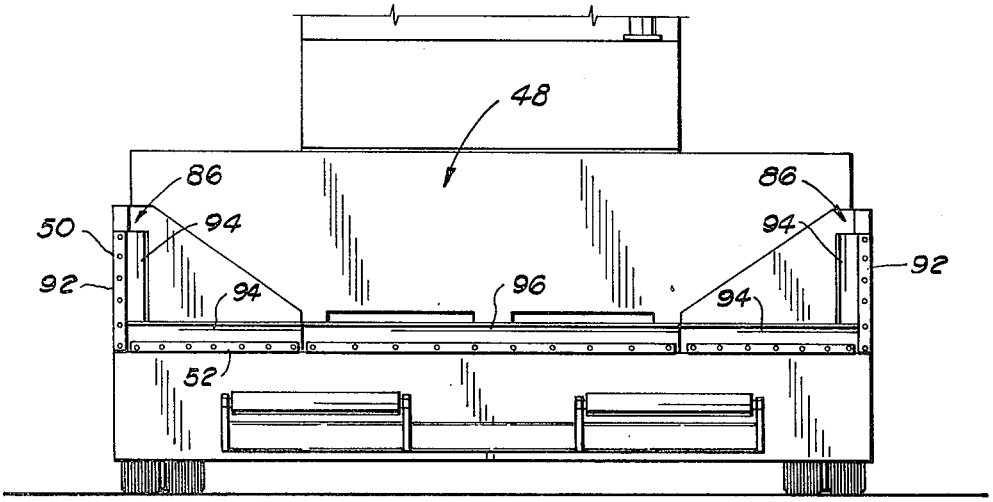
FIG. 3A is a semi-detailed front view of the hopper assembly of the paving machine shown in FIG. 1.
Figure 3B:
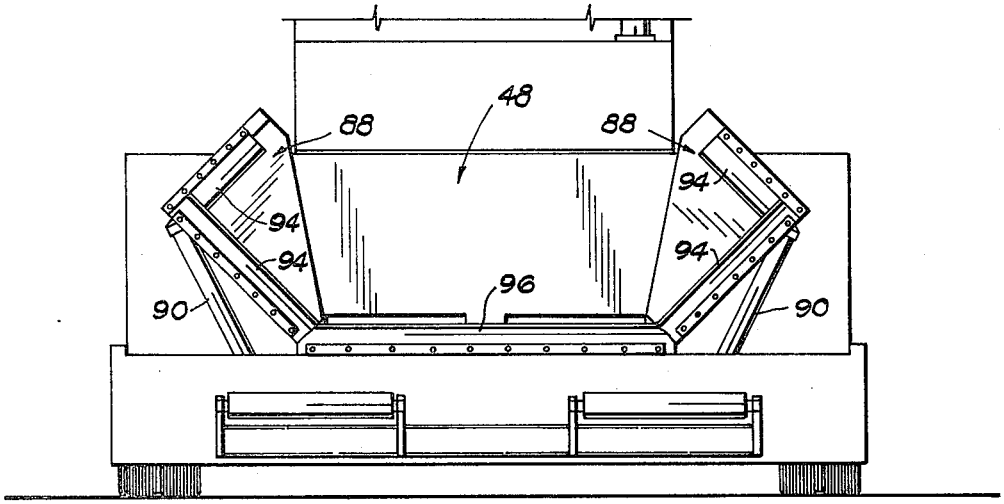
FIG. 3B shows the hopper assembly of FIG. 3A with the hopper members positioned in the paving material dumping mode.

As illustrated in FIGS. 3A and 3B, the first hopper member 44 is pivotally positionable in a first positional mode 86 and in a second positional mode 88. In the first positional mode 86, the first hopper member 44 is in a material receiving positional mode, and in the second positional mode 88, the first hopper member 44 is in a material dumping positional mode. In like manner, the second hopper member is pivotally positionable in a first positional mode, or a material receiving positional mode 86 and in a second positional mode, or a material dumping positional mode 88.

As shown in FIG. 3B, a hydraulic ram 90 is connected between each of the first and second hopper members 44, 46 and the frame assembly 12, for the purpose of selectively pivoting the first and second hopper members 44, 46 relative to the frame assembly 12. One of these hydraulic rams is shown in FIG. 2 and has one of its ends connected to an appropriate bracket on the frame assembly 12 and its other end connected to an appropriate bracket on the under surface of the floor member 78 of the second hopper member 46. It will be understood that the paving machine 10 is provided with a conventional high pressure hydraulic assembly for the selective actuation of the hydraulic rams 90, and upon actuation, the hydraulic rams 90 extend as shown in FIG. 3B to pivot the first and second hopper members 44, 46 upwardly so that the first and second hopper members 44 and 46 are positioned in the material dumping positional mode 88, and when the hydraulic rams 90 are retracted, the first and second hopper members 44 and 46 are lowered to assume the material receiving positional mode 86.

The purpose for causing the first and second hopper members 44 and 46 to assume the material dumping positional mode 88 is to cause the paving material that has been received in the material receiving cavity 48 to be moved to a center position between the two hopper members 44, 46 in order to completely empty the contents of the material receiving cavity 48, as will be clear following the discussion of the salt conveyors which follows.

A material boundary seal is effected by the placement of curved pieces of neoprene rubber along the ends 92 of the first and second hopper members 44 and 46. That is, in order to provide a partial seal at the ends 92, which are open, a material boundary seal is effected by the bolting of inwardly curving pieces of neoprene rubber 94 to the ends 92 by conventional bolts and appropriately threaded apertures located in the ends 92. An additional curved piece of neoprene rubber 96 is bolted along the front upper edge of the front end 18 of the frame assembly 12 between the neoprene pieces 94 to provide a continuous material boundary seal as shown in FIG. 3A.

Returning now to FIG. 1, shown therein are the first and second slat conveyors 100 and 102 that provide the material transfer assembly to move the paving material loaded into the material receiving cavity 48 rearwardly relative to the frame assembly 12. A detailed description of the construction of the slat conveyors is not necessary for the purposes of this disclosure, as such conveyors are conventional in design. It is sufficient to state that each of the slat conveyors 100, 102 is comprised of a pair of endless chains disposed in parallel spaced apart relationship to each other and supported by spaced apart shaft mounted gears that are powered by a hydraulic motor to move the pair of chains along a wear plate, and a plurality of drag slats are connected between the endless chains so as to drag paving material along the wear plate. As shown in FIG. 1, the drag slots 104 of the first slat conveyor 100 are connected between a pair of endless chains (not shown) and are positioned to be dragged along a wear plate 106. FIG. 1 also shows the drag slats 104 of the second salt conveyor 102 disposed in material drag relationship over the wear plate 108. Adjacent to the cross brace members 64 and 84 that form the back portions respectively of the first and second hopper members 44 and 46, there is a cowling panel 110 that serves as the rear wall of the material receiving cavity 48. The panel 110 has a first opening 112 and a second opening 114 located directly above the first and second slat conveyors 100, 102 respectively. Paving material moved by the first slat conveyor 100 is caused to pass through the opening 100, and a clearance channel is provided for the slat conveyor to move the paving material rearwardly to the point of its discharge from the slat conveyor 100. In like manner, the second slat conveyor 102 moves material from the material receiving cavity 48 through the opening 114 and a clearance channel is provided therefor. A pair of gate panels (not viewable in FIG. 1) are positioned behind the panel 110 to vary the openings 112 and 114. The gate panel associated with the opening 112 is a planar member attached to a holder rod 116 that passes upwardly through an appropriately placed aperture in the cover panel 118 which is part of the cover cowling for the engine and hydraulic equipment of the paving machine 10. An adjustable supporting bracket of conventional design grips the holder rod 116 and permits adjustment of the gate panel to vary the size of opening through which paving material is permitted to pass during its transfer rearwardly by the first slat conveyor 100. A gate panel of similar construction is in like manner disposed to vary the opening 114 through which the paving material passes from the material receiving cavity 48 via the second slat conveyor 102.

Figure 4:
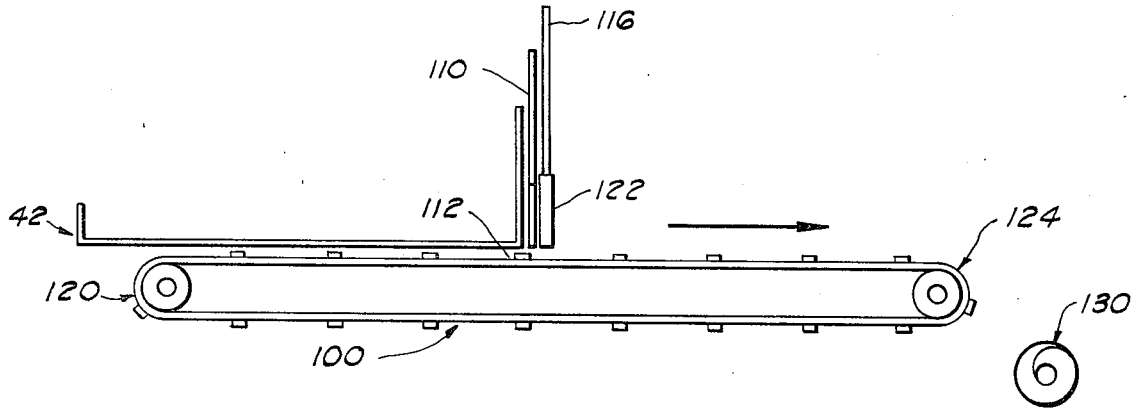
FIG. 4 is a diagrammatical view of the material transfer mechanism of the present invention.

Each of the slat conveyors 100, 102 has a first end portion 120 that is positioned in paving material receiving relation to the hopper assembly 42. A diagrammatical representation of the material transfer mechanism of the present invention is shown in FIG. 4. A first transfer assembly is provided by the first slat conveyor 100 that moves paving material from the hopper assembly 42 through the opening 112 and under the gate panel 122 that is adjusted to a predetermined distance above the first slat conveyor 100 as above discussed. A second end portion 124 of the first slat conveyor 100 is disposed in dispensing relation to a first screw conveyor that spreads the paving material transversely to the road bed over which the paving machine 10 travels, the first screw conveyor being described in more detail hereinbelow. The second slat conveyor 102 is identical in construction to that of the construction of the first slat conveyor 100, the second slat conveyor 102 providing a second transfer assembly whereby paving material is transferred from the hopper apparatus 42 to a second screw conveyor apparatus, the second slat conveyor 102 having a first end portion 120 that is positioned in paving material receiving relation to the hopper assembly 42 and a second end portion 124 that is positioned in paving material dispensing relation to the second screw conveyor apparatus. The second screw conveyor, as for the first screw conveyor, will be described in more detail hereinbelow.

As shown in FIG. 1, the slat conveyors 100 and 102 are located beneath the framing members 126, 128, and 130 that serve to frame the bottom of the material receiving cavity 48 while covering the endless chains of the first and second slat conveyors 100, 102, thus permitting material to be loaded directly onto the first end portions 120 of the first and second slat conveyors 100, 102.

Figure 5:
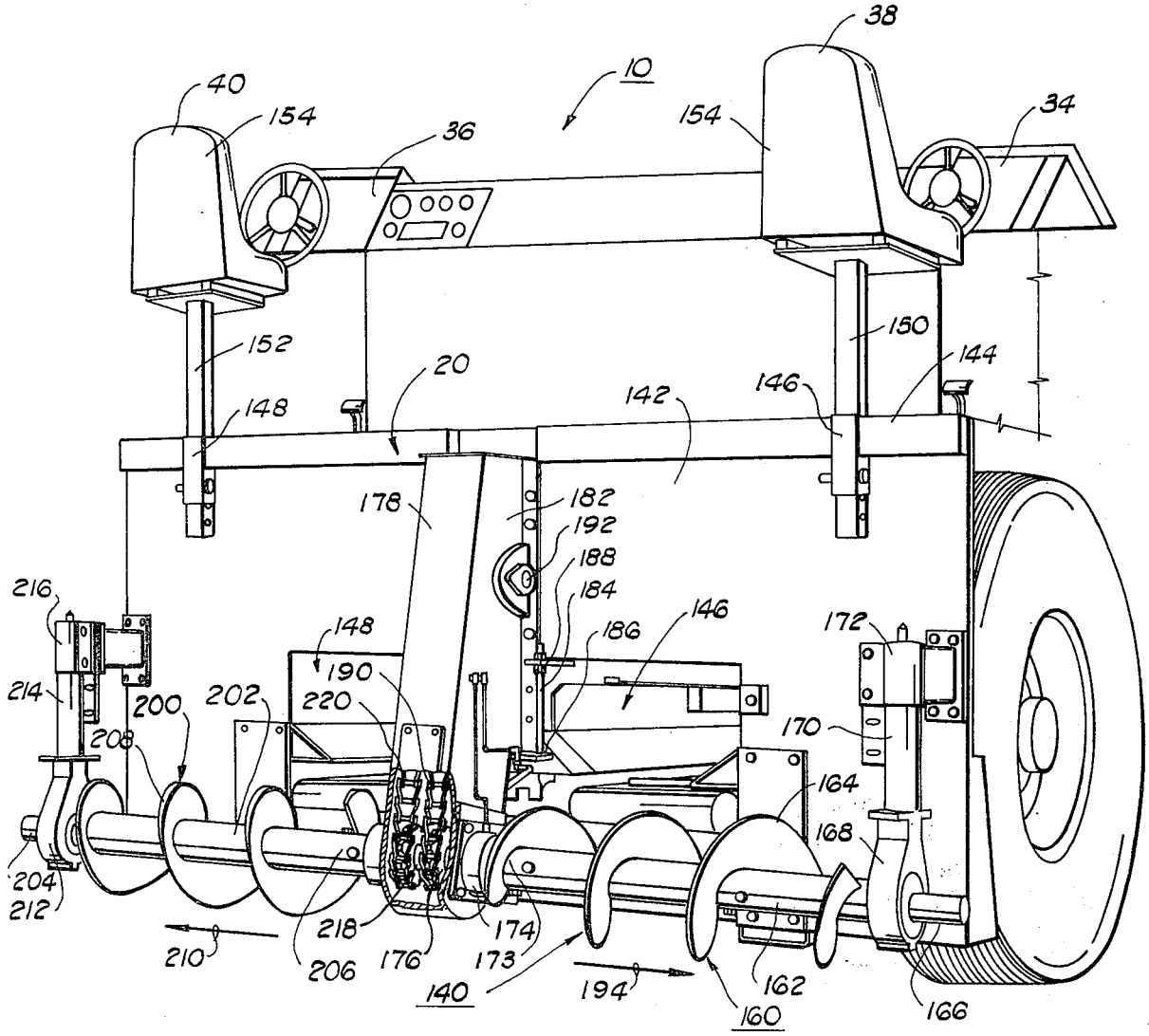
FIG. 5 is an isometric rear view of the paving machine shown in FIG. 1, without the screed assembly attached thereto.

Turning now to FIG. 5, shown therein is an isometric rear view of the paving machine 10 without the screed assembly which will be described below. FIG. 5 is a view of the rear end 18 where the paving material transfer spreader assembly 140 is attached. The frame assembly 12 has a rear plate 142 that is disposed across the back of the paving machine 10. Across the top of the rear plate 142 there is welded a stiffener bar 144, having a pair of support sockets 146 and 148 at spaced apart intervals for the receiving therein of the chair stems 150 and 152 respectively of the operator supports 38 and 40. A pair of cushion assemblies 154 are mounted on the chair stems 150 and 152 as shown. Conventional bolting means may be used to secure the chair stems 150 and 152 in the sockets 146 and 148.

The earlier mentioned clearance channels for the slat conveyors 100, 102 are provided through the rear plate 142 at openings 146 and 148 respectively. The second end portion 124 of the slat conveyor 100 is disposed so as to discharge paving material transferred rearwardly from the hopper assembly 42 out of the opening 146, and in like manner, the second end 124 of the slat conveyor 102 is disposed to discharge paving material out of the opening 148.

A first spreader assembly 160 is provided for spreading the paving material that drops from the slat conveyor 100 through the opening 146 transversely to the driven direction 30 of the paving machine 10 along the roadway over which the paving machine 10 is caused to be driven in a paving operation. The first spreader assembly 160 is comprised of a helical, screw conveyor member that has an axle 162 about which a helically winding blade 164 is attached. The axle 162 has a bearing end 166 that is bearingly supported by a vertical screw mounting bracket 168 having a vertically extending rod member 170. A support bracket 172 has an appropriately sized aperture for slidingly receiving the rod member 170, and a conventional bolting means is employed to secure the rod 170 in the support bracket 172 in a manner that permits varying the height of the bearing end 166 of the axle 162 over the roadway. The other end 173 of the axle 162 is supported by a conventional bearing block 174, and the end 173 is attached to a drive sprocket 176. An adjustable housing 178 supports the bearing block 174 and is mounted via conventional bolts through appropriately placed holes in the flare edge 180 protruding from the right wall 182 thereof, to the rear plate 142. Although not shown, the housing also has a similarly constructed left wall and protruding flare edge on the other side of the housing 178 that affords bolting connection to the rear plate 142. A plurality of threaded apertures are appropriately located in the rear plate 142, and by the selection of a set of these threaded holes, the height of the housing 178 is varied by the placement of the bolts through the flare edges 180 and threadingly engaging the selected holes, thereby providing means whereby the height of the end 173 is adjustably supported over the roadway. A threaded bolt 184 extends upwardly from a tab 186 that extends from the right wall 182 of the housing 178. An apertured tab 188 extends from the rear plate 142, and the upper end of the support bolt 184 is disposable through the aperture of the tab 188. A pair of conventional nut members are threadingly engaged on either side of the tab 188. The support bolt 184, along with a similar support bolt structure located on the other side of the housing 178 (not viewable in FIG. 5), provides means for holding the housing 178 during the adjustment of the height of the housing 178 relative to the roadway. That is, the support bolts 184 are used to support the housing 178 when the bolts are moved from the flare edges 180 for the purpose of adjusting the height of the housing relative to the roadway, with the support bolt providing means to raise or lower the housing 178 during such adjustment.

The bearing block 174 is attached to the right wall 182 of the housing 178, and the end 173 extends through the bearing block 174 into the interior of the housing 178. The drive sprocket 176, secured to the end 173 of the axle 172, is driven by a chain 190 drivingly connected to a sprocket (not shown) mounted on a shaft 192, the shaft 192 being bearingly connected to the right wall 182 of the housing 178. A hydraulic motor, not shown, is drivingly connected to the chain 190 to effectuate the rotation of the screw conveyor 160. The helical blade 164 is pitched so as to cause the paving material dispensed from the slat conveyor 100 to be spread in the direction 194 by the turning of the helical blade 164, the direction 194 being transverse to the driven direction 30.

As viewed in FIG. 5, the first spreader assembly 160 comprises generally one half of the spreading capability of the paving material transverse spreader assembly 140, as paving material is spread from the first slat conveyor 100 in the direction 194 transversely across the roadway. A second spreader assembly 200 identical in construction to the first spreader assembly 160, with the exceptions noted, is disposed in paving material receiving relation to the second end portion 120 of the second slat conveyor 102 which dispenses paving material from the hopper assembly 42 through the opening 148 in the rear plate 142. The second spreader assembly 200, also referred to as the second screw conveyor, has an axle 202 having an end 204 and an end 206. A helically winding blade 208 is attached around the axle 202, and is pitched to move paving material in the transverse direction 210 when the axle 202 is rotated in the appropriate rotational direction. The end 204 is bearingly supported in a mounting bracket 212 that has a vertically extending rod member 214 which is in turn adjustably supported via conventional bolting means in a support bracket 216. The other end 218 of the axle 202 is bearingly supported via a bearing block (not shown) mounted on the left wall (not shown) opposite to the right wall 182 of the housing 178. The end 206 has a drive sprocket 218 mounted thereto and a chain 220 is drivingly engaged with the sprocket 218. A shaft similar to the shaft 192 is bearingly mounted on the left wall of the housing 178, and a sprocket (not shown) is mounted on the shaft to engage the chain 220. A second hydraulic motor, to be described below, is drivingly engagable with the chain 220 for the purpose of driving the second screw conveyor 200 in a rotational direction to effectuate the spreading of paving material in the direction 210. It will be understood that the second screw conveyor 200 is adjustable so as to be generally in axial alignment with the first screw conveyor 160.

The paving material transverse spreader assembly 140, comprising the first and second screw conveyors 160, 200, in cooperation with the first and second slat conveyors 100, 102, provides an arrangement whereby paving material that is received in the hopper assembly 42 is placed uniformly across the roadway transversely to the driven direction 30 of the paving machine 10. The purpose of this is to provide a paving material feeding mechanism that deposits paving material in front of a screed assembly which will now be described.

The paving machine 10 embodying the present invention, has a screed assembly for compressing paving material transversely spread on the roadway by the paving material transverse spreader assembly 140. Preferably, the screed assembly is of the floating screed type as shown in FIGS. 1 and 2 wherein the screed assembly 230 is shown behind the paving machine 10. Floating screeds are well known in the paving art, and only a brief description need be provided for the purpose of this disclosure. Accordingly, a semi-diagrammatical depiction of the screed assembly 230 is shown in FIGS. 6A and 6B, which are respectively side and plan views.

Figure 6A:
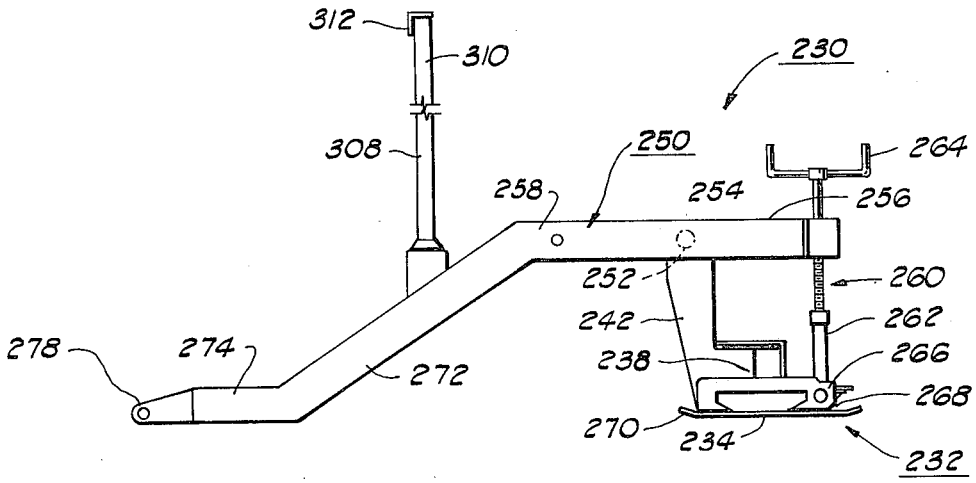
FIG. 6A is a semi-diagrammatical side view of the floating screed assembly that is pulled behind the paving machine of FIG. 1.
Figure 6B:
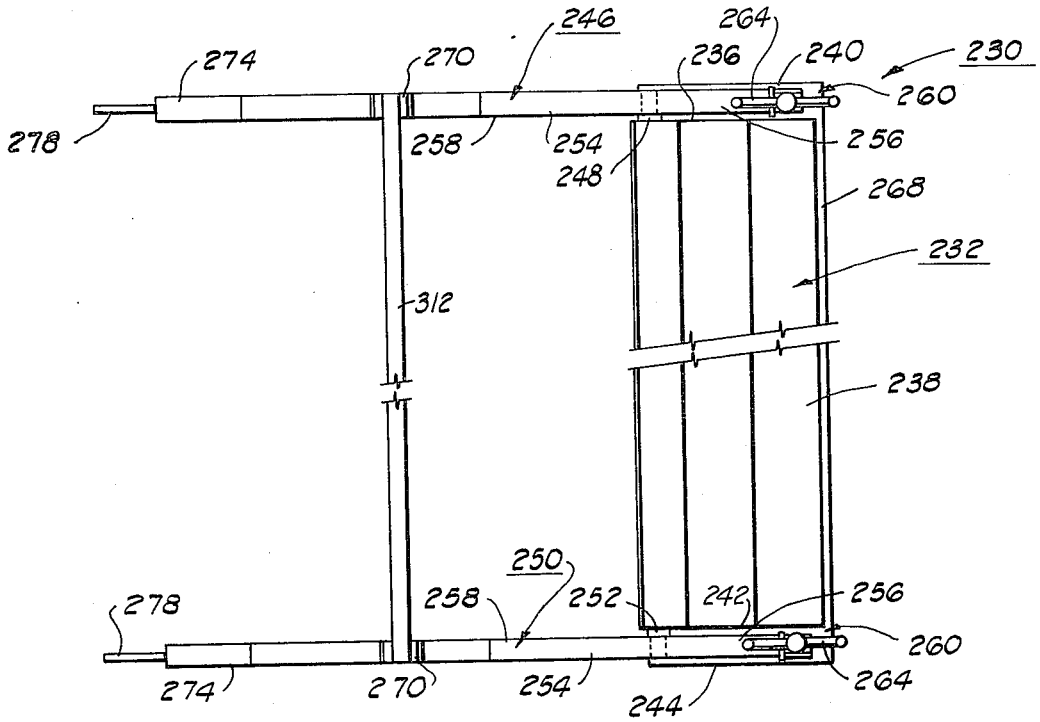
FIG. 6B is a semi-diagrammatical plan view of the screed assembly of FIG. 6A.

In FIGS. 6A and 6B, the screed assembly 230 comprises a screed member 232 that has a planar undersurface 234 that compresses paving material deposited in the path of travel of the screed assembly 230. While the undersurface 234 is depicted as a flat, planar surface, it will be understood that techniques are well known for the use of a curved undersurface to effectuate a crown in the paved surface, and such mechanisms need not be described herein. Further, other screed mechanisms such as heaters and vibrators are also well known in the art, and need not be described herein for the purposes of this disclosure.

Figure 7:
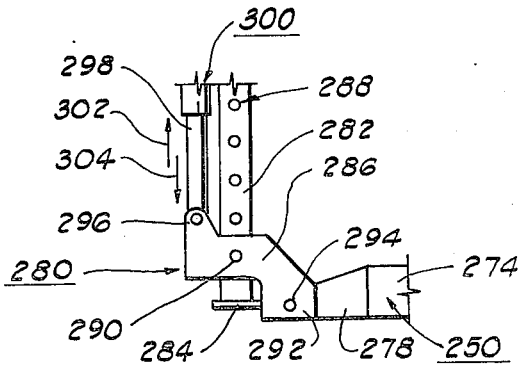
FIG. 7 is a view of a connector assembly for attaching the tow point connection portion of one of the pulling arms of the screed assembly to the paving machine of FIG. 1.

A first riser member 236 extends generally vertically from the upper surface 238 of the second member 232 near the first end 240 thereof, and a second riser member 242 extends generally vertically from the upper surface 238 near the second end 244 of the screed member 232. A first pulling arm 246 is connected to the first riser member at the pivotal connection point 248, which is a conventional shaft and bearing connection. A second pulling arm 250 is connected to the second riser member 242 at the pivotal connection 252, which is similar to the pivotal connection point 248. The first and second pulling arms 246, 250 are essentially identical in construction; therefore, the second arm 250 will be described with reference to FIG. 6B, from which description the construction of the first pulling arm 246 will be readily understood. The second pulling arm 250 has a first elongated member 254 which extends forwardly and rearwardly to the pivotal connection point 252, having a rear portion 256 and a forward portion 258. Near the end of the rear portion 256, there is disposed a thickness crank assembly 260 which comprises a threaded shaft 262 threadingly retained in an appropriately sized and positioned aperture disposed through the rear portion 256. A crank handle 264 is connected to the top of the shaft 262 for the purpose of turning the shaft 262 to vary the distance of the shaft end 266 from the rear portion 256, the shaft end 266 pivotally connected to the screed 232 near the rear edge portion 268 thereof. By turning the crank handle 264, the screed 232 and the second riser member 242 is pivoted relative to the second pulling arm 250, thereby changing the angle of approach of the screed 232, the angle of approach being defined as the angle which the planar surface 234 makes with the paving material that is deposited in front of the screed 232 by the paving material transverse spreader apparatus 140. As shown in FIG. 6A, the leading edge portion 270 of the screed is tapered, as the screed member 232 must ride over the deposited paving material, the weight of the screed 232 compressing the material into a mat. A second elongated member 272 has one end connected to the forward portion 258 of the second pulling arm 250, and the other end is connected to one end of a third elongated member 274, the third elongated member 274 being generally parallel to the first elongated member 254. The other end 276 of the third elongated member 274 is distal to the pivotal connecting point 252 and serves as a tow point connection portion for the second pulling arm 250. An apertured tab 278 extends from the end 276 as shown in FIGS. 6A, 6B, and the connector assembly 280 is connectable thereto as shown in FIG. 7.

As shown in FIG. 1, a hanging post 282 is attached to and extends in a generally downward direction from the frame assembly 12. The hanging post 282 is a tube of rectangular cross sectional area having a stay plate 284 welded normally across the bottom. The connector assembly 280 has a body portion 286 that has a bore shaped to slidingly receive the hanging post 282 as shown in FIGS. 1 and 7. A row of apertures 288 is provided in the hanging post 282, and an aperture is provided through the body portion 286 of the connector assembly 280 for the insertion of a bolt member 290 to secure the connector assembly 280 at a selected position on the hanging post 282. The connector assembly has a yoke portion 292 that is formed to be placed over the tab 278 of the second pulling arm 250, a bolt 294 disposed through aligning apertures to pivotally secure the connector assembly 280 thereto. A pair of ear members 296 protrude from the body portion 286 of the connector assembly 280, and the extendible rod 298 of a hydraulic ram 300 is connected via conventional bolting means to the ear members 296. The other end of the hydraulic ram 300 is attached to the left side 16 of the frame assembly 12 under the cover panel 118, and for this reason, it does not show in the view of FIG. 1. A conventional source of pressurized hydraulic fluid is provided to power the hydraulic ram 300, and conventional valving means is provided to selectively control the extension and retraction of the extendible rod 298. As will be pointed out below, the movement of the extendible rod 298 in the upward direction 302, or alternately in the downward direction 304, effectuates a change in the thickness 306 of the paving material as viewed in FIG. 2.

As indicated above, the construction of the first pulling arm 246 is identical to that described for the second pulling arm 250, and another connector assembly 280 and hydraulic ram 300 connect the first pulling arm 246 in like manner to the right side 14 of the paving machine 10.

Returning to FIGS. 6A and 6B, shown therein is a vertical bar member 308 that is rigidly connected to and extends upwardly from the second elongated member 278. Although not viewable, another vertical bar member 308 is rigidly connected to and extends upwardly from the first elongated member 278, the vertical bar members being generally parallel to each other and joined across the top end 310 of each of the vertical bar members 308 by a rigid cross bar member 312. The cross bar member 312 serves to establish the position of the first and second pulling arms 246, 250 in spatial relationship to each other, whereby the corresponding portions of the first and second pulling arms are generally parallel and coplanar. In addition, a slope control sensor 314 is mounted on the cross bar member 312 as shown in FIGS. 1 and 2. While a rigidly attached cross beam 312 is depicted in the FIGS. 6A and 6B, it may be desirable to provide adjustable connecting joints as shown at 316 and 318 in FIG. 1 for the purpose of providing slope calibration of the cross bar 312, taking into account the dimensions of the particular paving machine, and other paving criteria. The connecting points 316, 318, are of conventional design and need not be described herein.

The above described screed 230 provides an arrangement whereby the screed 232 is pulled behind the paving machine 10 by means of the adjustably mounted tow points 278 connected via the hydraulic rams 300 which are in turn attached on either side of the paving machine 10. As the screed assembly 230 is pulled along the roadway in the driven direction of travel 30 by the paving machine 10, paving material is metered in front of the screed 232 by means of the paving material transverse spreader assembly 140, and the screed 232 compresses the paving material into an initially compacted mat. The rear edge portion 268 of the screed 232 is positioned relative to the first and second pulling arms 246, 250 via the thickness crank assemblies 260 which serve as thickness controls for the compacted mat.

The entire screed assembly 230 is free to pivot around the pin connections that connect the distal ends of the first and second pulling arms 246, 250 to the paving machine 10 since there are no mechanical connections to restrict the vertical travel of the screed 232. Therefore, the height at which the screed travels over the paving material deposited in front of it can be varied in order to vary the thickness of the compacted mat. The height at which the screed 232 will ride is influenced by several factors, including: the characteristics of the paving material mix being used; the speed at which the screed 232 is moving; the head of asphalt mix being deposited ahead of the screed; the approach angle at which the screed 232 is set; and the height of the tow points 278 in relation to the screed 232, which is effectuated by the actuation of the hydraulic rams 300. A variation of any one, or a combination of these factors will result in a variation occurring in the mat thickness 306 of the compacted paving material. Once the paving machine 10 is set up as required for a particular paving job, the first four factors will generally be maintained constant. The height of the tow points 278 in relation to the screed 232 over smooth grade will then remain constant. However, for irregular grade, it is desirable to provide automatic grade control of actuating the hydraulic rams 300 and consequently adjusting the height of the tow points 278 to compensate for a change in the grade. To this end, a hydraulic sensor 320 of known design is supported on an end panel 322 (not shown in FIGS. 6A and 6B) attached to the screed 232. Hydraulic sensors of the type shown are well known in the paving art, and it is sufficient to state that the hydraulic sensor 320 is a four-way valve that is output-positionable by the movement of a pivotal wand 324 that is set to follow a stringline or other external reference plane, such as a traveling ski line, curb, etc. This provides a grade control system that lays a smooth mat at a specified elevation because the hydraulic sensor 320 senses any vertical movement of the screed 232 via the movement of the wand 324 as either the stringline reference or the paving machine 10 changes in relative elevation. The tow points 278 are then raised or lowered to adjust the screed 232 back to the desired elevation. Grade control can be used on both sides of the machine; on one side of the machine with the other side controlled by the hydraulic sensor 320; or on one side with the other side riding free on the previously laid paving mat.

The above mentioned slope control sensor 314, which may be of the pendulum-gravity type, is capable of detecting a deviation in the slope of the cross bar member 312, and an output signal is generated that is proportional to the change of the slope of the cross bar member 312 in reference to a reference slope. Such devices are well known in the paving art, and a further description will not be necessary for the purpose of the present disclosure. The slope control sensor 314, mounted on the cross beam 312 that spans the two pulling arms 246, 250, senses any deviation of the screed 232 or the tow points 278 from the cross slope set in the system. When a deviation from the set cross slope is sensed, the slope control sensor 314 directs pressurized hydraulic fluid from a source of pressurized hydraulic fluid to the appropriate end of the tow point hoist hydraulic ram 300 on the side of the paving machine 10 being controlled by the slope control sensor 314. The tow point hoist hydraulic ram 300 brings the screed 232 back to the set across slope by the appropriate extension or contraction of the extendible rod 298 of the hydraulic ram 300, and the slope control sensor 316 then stops the flow of hydraulic fluid to the actuated hydraulic ram 300. Slope control is normally used in conjunction with grade control on one side of the machine, but the slope control described above can be used to maintain a given cross slope with the screed tow point 278 on one side set in a fixed position.

Returning now to FIGS. 1 and 2, the suspension system of the present invention was briefly mentioned hereinabove as comprising the front suspension and steering assembly 22 and the rear suspension assembly 24. The rear suspension assembly 24 is of conventional design, comprising a pair of rear wheel assemblies 28 that are preferably powered by an engine and a hydraulic drive means that are conventional in design. Conventional braking assemblies should be provided as parts of the rear suspension assembly 24 in order to provide braking capability for the paving machine 10.

Figure 8:
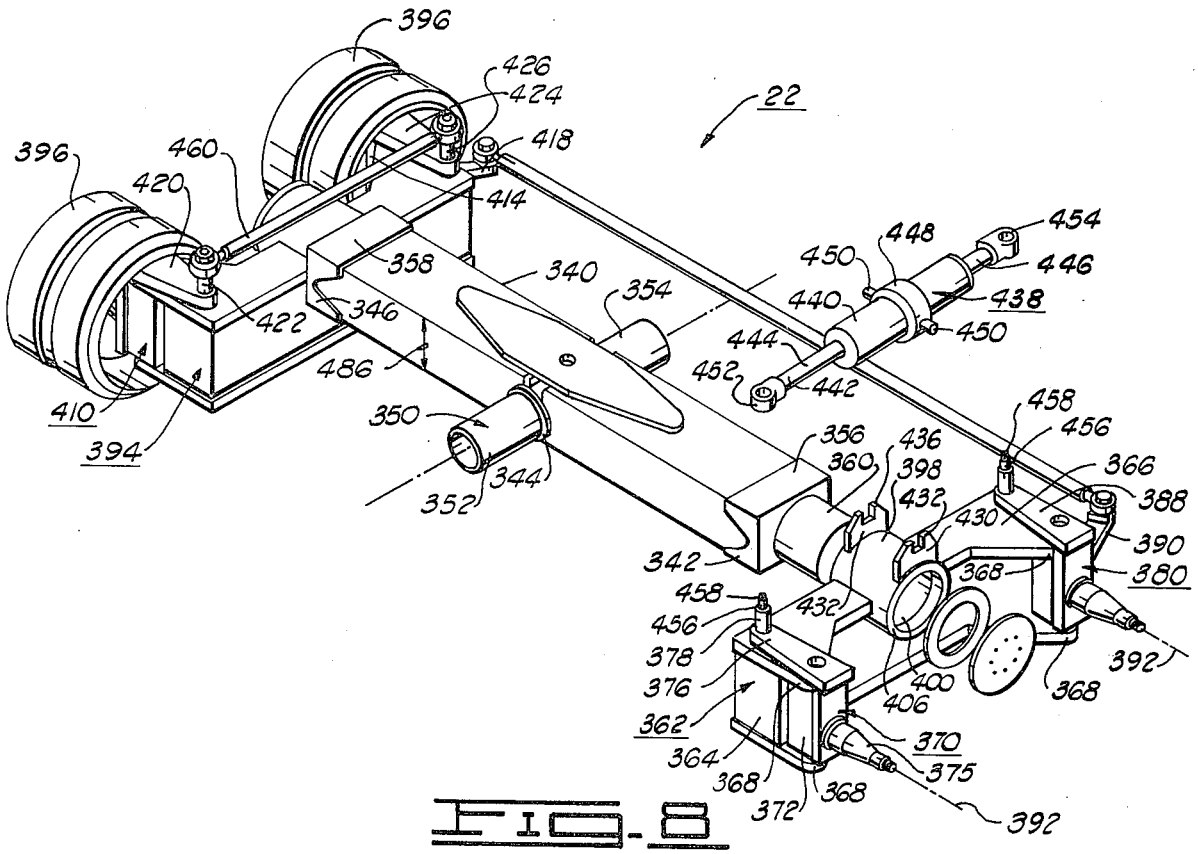
FIG. 8 is an isometric view of the front suspension and steering assembly, shown in partial exploded view, of the paving machine of FIG. 1.

The front suspension and steering assembly 22, shown in partial exploded view in FIG. 8, comprises a cross trunnion member 340 having a first end 342, a midpoint 344 and a second end 346. An aperture is disposed through the cross trunnion member 340 at the balance axis 348 that passes through the midpoint 344, and a center support shaft 350 is bearingly disposed through the aperture having a first extending end 352 and a second extending end 354. The cross trunnion member 340 must necessarily be sufficiently strong to withstand the stresses borne by supporting a substantial portion of the weight of the paving machine 10. Therefore, it may be desirable to fabricate the cross trunnion member 340 from rectangular tubular steel stock as shown, and to weld an end cap 356 over the first end 342 and an end cap 358 over the second end 344 as shown. Extending from the end cap 356 is an axle 360, and mountable on the axle 360 for pivotation thereon is a first bogie member 362 having a front end 364 and a rear end 366.

The front end 364 of the first bogie member 362 has a pair of spaced apart, protruding parallel lugs 368, each of which has an aperture therethrough, these apertures being aligned for the insertion therein of a kingpin arbor (not shown). A first spindle member 370 having an apertured body portion 372 is pivotally mounted on the kingpin arbor which is retainingly mounted in the aligned apertures of the lugs 368, the spindle member 370 being pivotal about an axis passing through the kingpin arbor and extending normal to the roadway over which the paving machine 10 is caused to travel. A plate 374 is attached to the body portion 372, and a front spindle arbor 375 extends normal to the plate 374. A crank arm 376 is attached to the plate 374 at one end thereof, and the other end of the crank arm has an upward standing connector post 378. Conventional bearings and bushings are utilized in the connection of the kingpin arbor and the spindle member 370.

In like manner, a second spindle member 380 is mounted for pivotation between the parallel apertured lugs 368 extending from the rear end 366 of the first bogie member 370. The construction of the second spindle member 380 is similar to the first spindle member 370, and comprises an apertured body portion 382, a plate 384, a rear spindle arbor 386 and a crank arm 388, these components being interconnected in the same manner as described for the first spindle member 370. A connector post 389 extends upwardly from the distal end of the crank arm 388. A tie rod crank arm 390 is attached to the body portion 382 and extends rearwardly from one side thereof in a manner to be nonrestrictive of the rotational movement of the second spindle member 380 relative to the first bogie member 362.

The front spindle arbor 375 and the rear spindle arbor 386 are aligned so that the longitudinal axis 392 of each is coplanar, and wheels are mounted in a conventional manner on the front and rear spindle arbors 375, 386, utilizing appropriate bearings and attaching means. Wheels are not shown on the front and rear spindle arbors 375 and 376 in FIG. 8, in order to more clearly illustrate the first bogie member 362 and the components that are mounted thereon. A second bogie 394 is mounted at the second end 346 at the cross trunnion member 340 in identical fashion to that of the first bogie member 362, and the wheels 396 are shown mounted thereon.

The first bogie member 362 has a cylindrical portion 398 having an internal bore 400 that is sized to bearingly receive the axle 360. Of course, an appropriate bearing means is utilized therewith. Attachment means secure the first bogie member 362 onto the axle 360, such as bolts (not shown), a retaining plate 402, and a spacer 404 secured by the bolts against the face 406 of the cylindrical portion 398. The shape of the first bogie member 362 is selected so as to be symmetrical about the axis 408 that extends through the longitudinal center of the bore 400 of the cylindrical portion 398.

A detailed description of the second bogie member 394 will not be given herein, for the reason that the second bogie member 394 is similar in construction detail to that which has been described for the first bogie member 362. Of course, the component parts associated with the second bogie member 394 are arranged with a first spindle member 410 pivotally mounted at the front end 412 of the second bogie member 394, and a second spindle member 414 pivotally mounted at the rear end 416 of the second bogie member 394. The second spindle member 414 has a tie rod crank arm 418 extending rearwardly in like manner to the tie rod crank 390. A crank arm 420 is attached to the first spindle member 410, having an upwardly extending connector post 422, and a crank arm 424 is attached to the second spindle member 414, having an upwardly extending connector post 426. The second bogie member 394 is pivotally attached to an axle (not shown) that extends from the end cap 358 on the second end 346 of the cross trunnion member 340 in the manner described hereinabove for the pivotal attachment of the first bogie member 362 to the axle 360.

The wheels 396 are mounted to the front and rear spindle arbors (not shown) of the first and second spindle members, 410, 414, and each of the wheels 396 is pivotal about an axis extending longitudinally through its respective kingpin arbor (not shown), each of these axes extending generally normal to the roadway upon which the paving machine 10 is supported. Thus, the wheels (not shown) connected to the first bogie member 362 comprise a first pair of wheels that are supported in tandem relationship near the ends of the first bogie member 362 (as viewed in FIG. 1), each of the wheels being mounted for pivoting relative to the first bogie member 362 about an axis passing through its respective kingpin and extending generally normal to the roadway. In like manner, the wheels 396 connected to the second bogie member 394 comprise a second pair of wheels that are supported in tandem relationship near the ends of the second bogie member 394, each of the wheels of the second pair of wheels being mounted for pivotation relative to the second bogie member 394 about an axis that extends through its respective kingpin and extending generally normal to the roadway. The apparatus to pivot the first pair of wheels and the second pair of wheels in unison for steering control of the paving machine 10 will now be described.

As shown in FIG. 8, a protruding first lug 430 extends upwardly from the outer surface of the cylindrical portion 398 of the first bogie member 362, the first lug having a notch 432. In like manner, a protruding second lug 434 extends upwardly from the cylindrical portion 398, having a notch 436, the notch 432 and the notch 436 respectively of the first and second lugs 430 and 434 being generally aligned so as to form a ram cradle. A hydraulic ram 438 is provided having a cylinder portion 440 and an extendible rod 442, the extendible rod 442 having a first end 444 and a second end 446. The hydraulic ram 438 is a double acting type of hydraulic ram, and pressurized hydraulic fluid is selectively exerted to the ports thereof (not shown) to effectuate the simultaneous extension of the first end 444 and the retraction of the second end 446, or alternately, the extension of the second end 446 and the retraction of the first end 444.

At approximately the midpoint of the cylinder portion 440, a ring clamp 448 encircles the hydraulic ram 438, and a pair of trunnion axles 450 extend from the clamp 448 with one of the axles 450 disposed on each of the opposite sides of the hydraulic ram 438. The trunnion axles 450 are axially aligned, and are dimensioned to be pivotally supported in the notches 432 and 436 respectively of the first and second lugs 430 and 434 that extend from the cylindrical portion 398 of the first bogie member 362. The dimension between the first lug 430 and the second lug 434 is established to be greater than the outer diameter dimension of the ring clamp 448, the reason for which will become clear below.

Attached to the first end 444 of the extendible rod 442 is a connector 452, and a similar connector 454 is attached to the outer end 446. The hydraulic ram 438 is connected between the first and second spindle members 370 and 380 as follows. The trunnion axles 450 are placed in the notches 432 and 436 respectively in the first and second lugs 430 and 434, the connector 452 is pivotally attached to the connector post 378, and the connector 454 is pivotally attached to the connector post 389. As shown in FIG. 8, each of the connector posts 378, 389 has an arbor portion 456, and a threaded end 458. The connectors 452 and 454 each are apertured to fit over the arbor portion 456 of the respective connector posts 378, 389. Bolting means (not shown) attached to the threaded ends 458 to secure the connectors 452, 454 thereto. Of course, it is known to use bushings and the like in this type of connection.

The arrangement of the trunnion mounted hydraulic ram 438 in the cradle formed by the first and second lugs 430, 434, provides three dimensional freedom of movement for the hydraulic ram 438 during the pivoting of the first pair of tandem wheels (connectable to the first bogie member 362 as described) in unison. That is, hydraulic ram 438 is free to slidingly move laterally in the notches 432 and 436 as required when turning the crank arms 376 and 388 by the movement of the extendible rod 442 relative to the cylinder portion 440.

The connector post 422 and 426 located respectively on the first and second spindle members 410 and 414 connected to the second bogie member 394 are joined by the connecting rod 460, the connecting rod having a connector attached to each of its ends for attachment to the connector posts 422 and 426. Each of the connector posts 422 and 426 is configured as described for the connector posts 378, 389, and similar attaching means secure the connecting rod 460 to the connector posts 422 and 426. One or both of the connectors at the ends of the connecting rod 460 is adjustable so as to permit the adjustment of the length of the connecting rod 460 to precisely establish the length required between the connecting posts 422 and 426 to properly align the wheels 396.

The tie rod crank arms 390 and 418 have upwardly extending connector posts to which is connected the adjustable length cross tie rod 462 that has a connector attached to each of its ends of the type previously described, and bolting means and bushing means may be provided as appropriate.

Figure 9:
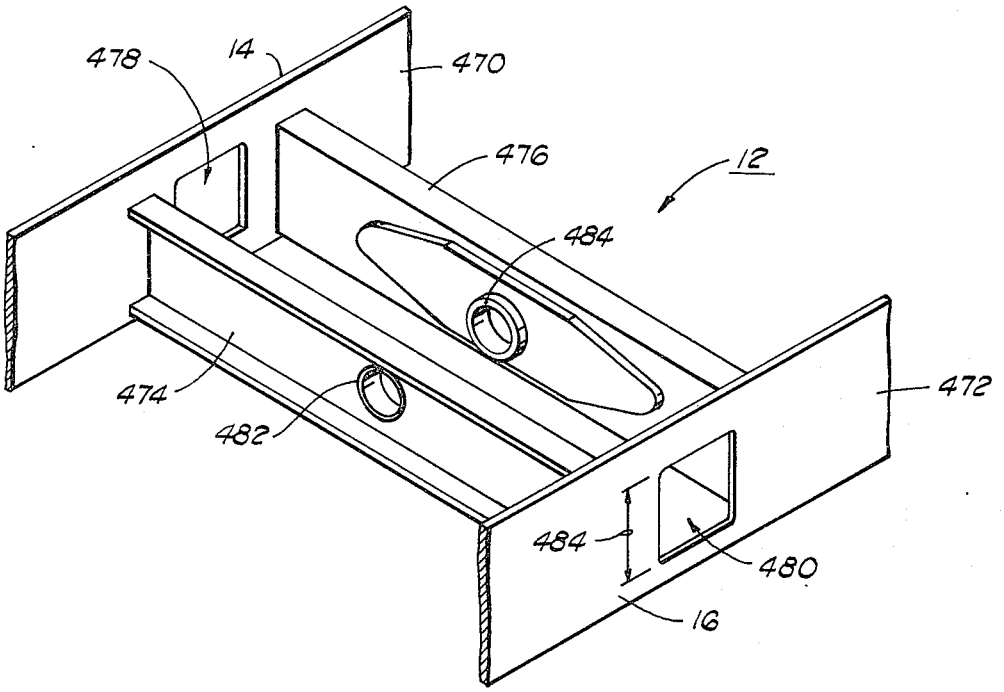
FIG. 9 is an isometric, partial view of a portion of the frame assembly of the paving machine shown in FIG. 1.

The above described front suspension and steering system 22 is mounted in the frame assembly 12 in the following manner. Running along a portion of the right side 14 of the paving machine 10 is a right side wall member 470, as shown in FIG. 9, which is a partial view of a portion of the frame assembly 12. A left side wall member 472 is disposed along a portion of the left side 16 in parallel, spaced apart relation to the right side wall member 470. A first transverse beam 474 and a second transverse beam 476 connect to and extend between the right side wall member 470 and the left side wall member 472, the first transverse beam 474 extending parallel to the second transverse beam 476. A right rectangular opening 478 is disposed in the right side wall member 470 between the junctures of the first and second transverse beams 474 annd 476 with the right side wall member 474. In like manner, a left rectangular opening 480, having the same dimensions and axially aligned with the right rectangular opening 478, is disposed in the left side wall member 472. The shape of each of the right and left rectangular openings 478 and 480 is predetermined so as to clearingly receive the ends 342 and 346 of the cross trunnion member 340 so that the ends thereof extend from the openings 478, 480 in the right and left side wall members 470, 472. This provides an arrangement such that the first bogie member 362 is disposed adjacent to the left side 16 of the paving machine 10, and the second bogie member 394 is disposed adjacent to the right side 14 of the paving machine 10. Appropriately sized openings (not shown) are provided rearwardly to the openings 478, 480 for the clearing passage therethrough of the cross tie rod 388 as required.

Located at the midpoint of the transverse beams 474, 476 are a pair of support bearings 482 and 484 having axially aligned bores. The center support shaft 350 is mounted for pivotation in the support bearings 482 and 484, and retained therein by conventional attachment means, the first extending end 352 being disposed in the bore of the bearing 482, and the second extending end 354 being disposed in the bearing 484. The dimension 484 of the right and left rectangular openings 478 and 480 is predetermined to be a dimension exceeding the thickness dimension 486 of the cross trunnion member 340 so that each end of the cross trunnion member 340 is permitted a total travel distance of about two inches relative to the right and left side wall members 470 and 472 as the cross trunnion member 340 pivots on the cross support shaft 350; this arrangement provides freedom for the paving machine 10 to shift its weight distribution within a limited degree of freedom in order to compensate for irregularities in the roadway grade, and to thereby relieve stress on the frame assembly 12 itself.

Up to this point in the present disclosure, the mechanical and operating functions of the paving machine 10 have been described. The remaining discussion herein will describe the mechanism whereby paving material is more accurately and uniformly dispensed in front of the screed 232 as the paving machine 10 moves in the driven direction 30. As was discussed above, paving material is received by the paving machine 10 in the material receiving cavity 48 of the hopper assembly 42, and the paving material is transferred rearwardly therefrom by the first slat conveyor 100 and the second slat conveyor 102. The paving material travels through the openings 112 and 114 which are backed up with the gate panels 122 that are vertically adjustable for the purpose of varying the amount of the openings 112, 114 available for paving material flowthrough, thereby effectively metering the flow of paving material passable for a given linear speed of the first and second slat conveyors 100, 102.

The first and second slat conveyors 100, 102 dispense the paving material onto the first and second spreader means, or screw conveyors 160 and 200 which spread the paving material transversely to the direction of travel 30. The paving material that is spread in front of the traveling screed 232 is provided compaction by operation of the weight of the screed 232 which is free to move vertically in its travel upon the mound of paving material spread by the first and second spreader means 160, 200.

Figure 10A:
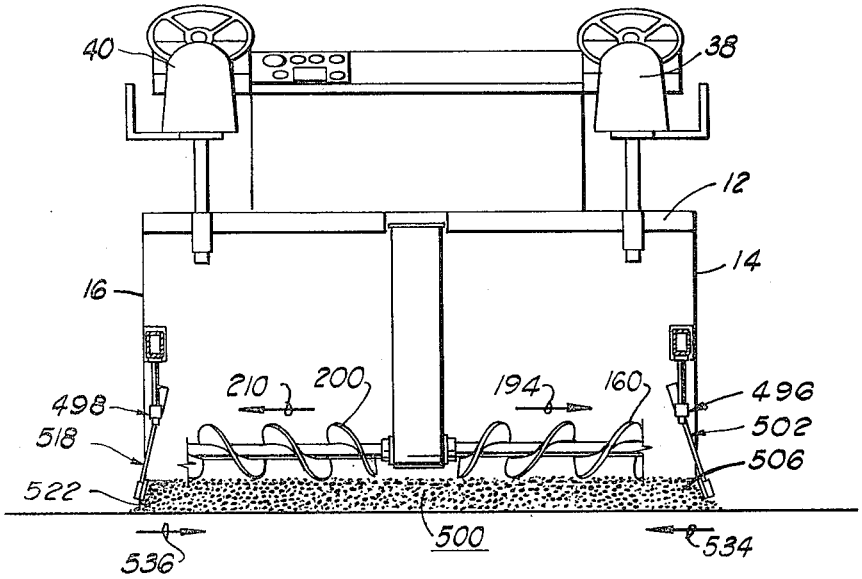
FIG. 10A is a diagrammatical depiction from the rear of the paving machine of FIG. 1 forming a mound of paving material.
Figure 10B:
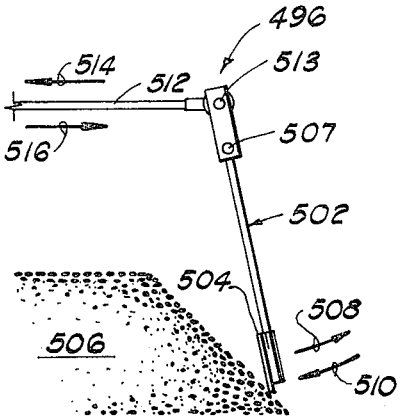
FIG. 10B is a diagrammatical view of one of the sensor assemblies of the paving machine in FIG. 1.

In order to assure a uniform width of the paving material across the entire width of the screed 232, a novel paving material distribution system is presented in the present invention as follows. Located at each side of the paving machine 10 near the outer end of each of the first and second spreader means 160, 200, there is provided a first and second sensor assembly 496, 498 for detecting the outer edges of the paving material mound. FIG. 10A is a diagrammatical depiction of the rear of the paving machine 10 as it forms a mound of paving material 500 that is dispensed from the first spreader means 160 and the second spreader means 200. Disposed near the right side 14 of the paving machine 10 is a first sensor assembly 496 which comprises a first paddle member 502 that is pivotally mounted on the frame assembly 12, the first paddle member 502 having a paddle end 504 that is contactingly engagable with the right outer edge or end 506 of the paving material mound 500, the paddle member 502 being pivotally supported at the pivot connection 507 on the frame assembly 12. This is more clearly viewable by the enlarged diagrammatical view of FIG. 10B. It will be understood at this point in the disclosure that the paving material in approximately the right half of the paving material mound 500 is that material which is spread by the first spreader means 160, the first spreader means 160 spreading the paving material transferred by the first slat conveyor 100 in the transverse direction 194. That is, as the paving material mound 500 is formed, the right outer edge 506 thereof is caused to dynamically form against the paddle end 504 of the first paddle member 502. The first paddle member 502 is caused to pivot in a first paddle direction 508 by the action of the paving mound end 506 pushing thereagainst. The weight of the paddle 506 exerts a countering force on the paddle member 502, thereby biasing the paddle member 502 to pivot in the second paddle direction 510. These countering forces on the paddle member 502 will cause the paddle end 506 to stay against the right outer end 506 of the paving material mound 500; that is, this is the case if the paving material is controllably dispensed by the first slat conveyor 100 and the first spreader means 160 in a manner that causes the first paddle member 502 to be pivotally disposed within its range of travel wherein these countering forces operate as defined.

The first paddle member 502 is attached to a first paddle linkage rod 512 at the pivot connection 513, and the linkage rod 512 translates the rotation movement of the paddle member 502 into linear motion of the first paddle linkage rod 512 in a first rod direction 514 and in a second rod direction 516. That is, when the first paddle member 502 is caused to move in the first paddle direction 508, the first paddle linkage rod 512 is moved in the first rod direction 514. Alternately, when the first paddle member 502 is caused to move in the second paddle direction 510, the first paddle linkage rod 512 is caused to move in the second rod direction 516. The purpose of this will become clear below.

In a similar manner to that of the first sensor assembly 496, a second sensor assembly 498 is disposed near the left end 522 of the paving material mound 500, and comprises a second paddle member 518 that is pivotally mounted on the frame assembly 12 near the left side 16 of the paving machine 10, the second paddle member 518 having a paddle end 520 that is engaged by the left end 522 of the paving material mound 500. In light of the above discussion for the first paddle member 502, it will be sufficient to here state that the second paddle member 518 is movable by the left mound end 522 in a first paddle direction 524, and the second paddle member 518 is biased by its weight distribution to move in the second paddle direction 526. A second paddle linkage rod 528 (not shown in FIG. 10A, but which may be viewed in FIG. 12 which will be described below) is connected to the second paddle member 518 and is movable in a first rod direction 530 and in a second rod direction 532. Stated differently, when the second paddle member 518 is caused to rotate (by the engagement therewith of the left end 522 of the paving material mound 500) in the first paddle direction 524, the second paddle linkage rod 528 is caused to move in the first rod direction 530, and alternately, when the second paddle member 518 is caused to rotate (by the influence of its biasing weight when the paddle end 520 is not opposed by the left end 522 of the paving material mound 500) in the second paddle direction 526, the second paddle linkage rod is caused to move in the second rod direction 532. The purpose of this will become clear in the discussion to follow.

It may assist in the understanding of the directions of travel of the first and second paddle members 502, 528 and the first and second paddle linkage rods 512, 528, to view the directions of travel as follows. In each case, the first paddle directions 508, 524 are rotational directions of the first and second paddle members 502, 518 away from the respective outer ends 506, 522 of the paving material mound 500, and in each case, the second paddle directions 510, 526 are rotational directions of the first and second paddle members 502, 518 toward the respective outer ends 506, 522. It should be recognized that when the amount of paving material that is delivered and spread by the cooperative efforts of the first and second slat conveyors 100, 102 and the first and second spreader means 160, 200 increases, the total length of the paving material mound 500 is increased, and the right and left outer ends 506, 522 move respectively in the directions 190, 210 to cause the first and second paddle members 502, 518 to move respectively in the first paddle directions 508, 524 and in the second paddle directions 510, 526. In contrast to this described condition of increasing paving material delivery, when the amount of paving material delivered by the first and second slat conveyors 100, 102 and the first and second spreader means 160, 200 decreases, the outer ends 506, 522 of the paving material mound 500 move respectively in the directions 534 and 536. When this occurs, the outer ends 506, 522 move away from the respective first and second paddle members 504 and 518, whereupon the first and second paddle members are permitted to move in the biased paddle directions 510, 524.

When the delivery rate of paving material by the first and second slat conveyors 100, 102 and the first and second spreader means 160, 200 is constant, it will be recognized that the mount ends 506, 522 will be affected by another paving criteria, that of grade irregularities in the roadway over which paving material is deposited. If the grade is smooth, it will be recognized that equilibrium conditions will be reached for a given constant paving material delivery and spreading rate, for the reason that the total length of the paving material mound 500 will remain constant, with its outer ends 506, 522 remaining stable relative to the respective directions 194, 534 and 210, 536. Of course, in actual paving operations, the grade of the roadway does have irregularities, and the purpose of the herein described paving material feed control apparatus is to stablize the location of the outer ends 506, 522 as the paving machine 10 deposits paving material over such irregularities. When a dip or high spot in the roadway is encountered, more or less paving material will be required to form the mound 500 so as to keep its total length the same, whereupon the outer ends 506, 522 thereof will remain at a predetermined setting. The purpose of the first sensor assembly 496 and the second sensor assembly 498 (comprised respectively of the first paddle member 502, and the first linkage rod 512; and, the second paddle member 518, and the second paddle linkage rod 528) is to sense the location of the outer ends 506, 522 of the paving material mound 500, and to provide a feedback signal by which responsive equipment is appropriately actuated to either increase or decrease the delivery rate of the paving material when a change of locations of the ends 506, 522 is incurred. Another way of expressing this is that the first and second sensor assemblies 496 and 498 detect a variable distance parameter (the location of the right and left outer ends 506, 522), the purpose of which will now be described with reference to FIG. 11.

Figure 11:
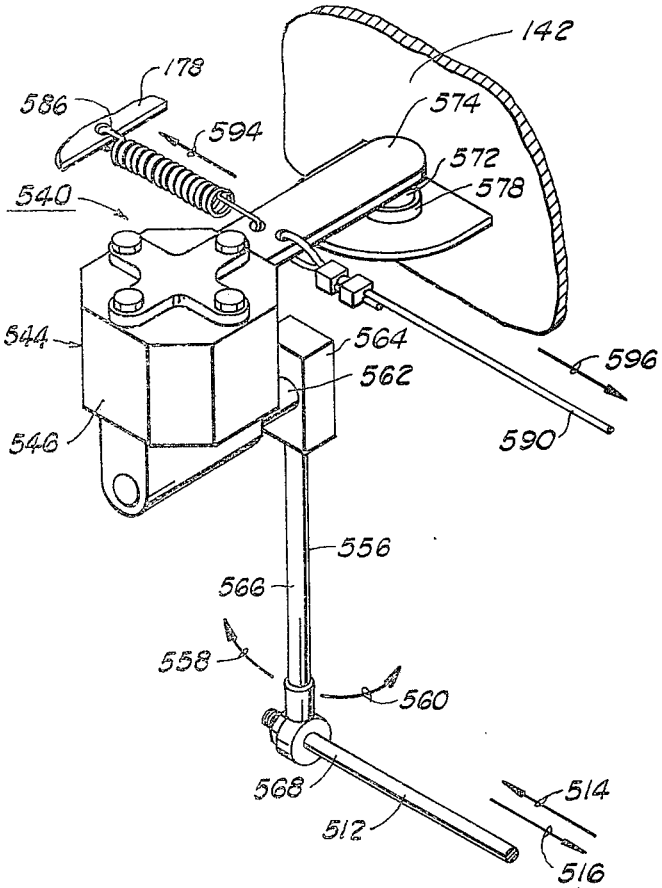
FIG. 11 is a view of a hydraulic porting valve assembly.

FIG. 11 is a view of a hydraulic porting valve assembly of the type to which each of the first and second paddle linkage rods 512 and 528 attach. As depicted in the diagrammatical view of FIG. 12, a first hydraulic porting valve assembly 540 and a second hydraulic porting valve assembly 542 are disposed along the rear plate 142 at the back of the frame assembly 12. Since the second hydraulic porting valve assembly 542 is essential identical in construction to the first hydraulic porting valve assembly 540, the description that follows for the first hydraulic porting valve assembly 540, as shown in FIG. 11, will be sufficient disclosure for the understanding of the construction and operation of the second hydraulic porting valve assembly 542. The first hydraulic porting valve assembly 540 comprises a first porting valve 544 of the well known type known as a four-way hydraulic valve, and is designed to serve as a proportional transducer, as taught, for example, in the patent to Curlett, et al., U.S. Pat. No. 3,158,945. The first porting valve 544 has a first valve body 546 having a power fluid inlet 548, a power fluid return port 550, a first power fluid outlet 552 and a second pressure fluid outlet 554. A first fluid control means 605 (described functionally below) is disposed in the first valve body to control the fluid flow through the first valve body 546. As such valves are conventional in the art, it is sufficient to state herein that the first fluid control means 605 is positionable in a first positional mode and in a second positional mode. A first pressure controlling mechanism 556 is pivotally connected to the first valve body 546 and is pivotal in a first control direction 558, and alternately, the first pressure controlling mechanism 556 is pivotal in a second control direction 560. The first pressure controlling mechanism 556 is attached via the pivoting support posts 562 to the first valve body 546 at the end 564 thereof, and the other end 566 of the first controlling mechanism 556 is connected to the end 568 of the first paddle linkage rod 512 by conventional attaching means.

It will be clear that movement of the first paddle linkage rod 512 in the first rod direction 514 causes the first pressure controlling mechanism 556 to move in the first control direction 558 relative to the first valve body 546. Alternately, movement of the first paddle linkage rod 512 in the second rod direction 516 causes the first pressure controlling mechanism 556 to move in the second control direction 560. The first fluid control means 605 is moved in response to the movement of the first pressure controlling mechanism 556, with the first fluid control means positioned in the first positional mode when the first pressure controlling mechanism 556 is moved in the first control direction 558 relative to the first valve body 546, and in this positional mode, the power fluid inlet 548 is in fluid communication with the first power fluid outlet 552, and the power fluid return port 550 is in fluid communication with the second power fluid outlet 554, as depicted in the simplified diagrammatical view of FIG. 13A.

Figure 13A:
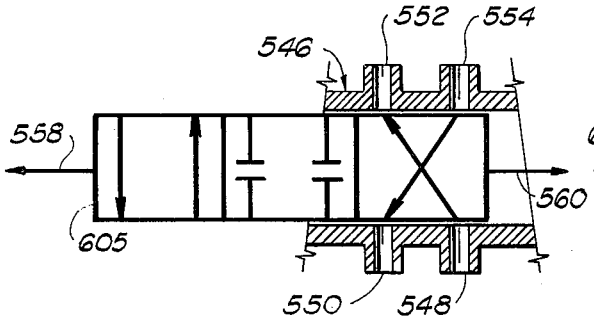
FIGS. 13A, 13B and 13C are diagrammatical depictions of the fluid communication positional modes of the hydraulic porting valve of FIG. 11. Similarly.
Figure 13B:
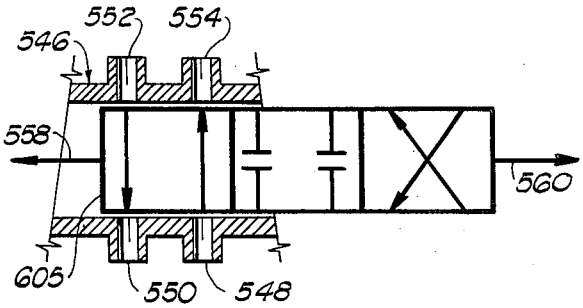
Figure 13C:
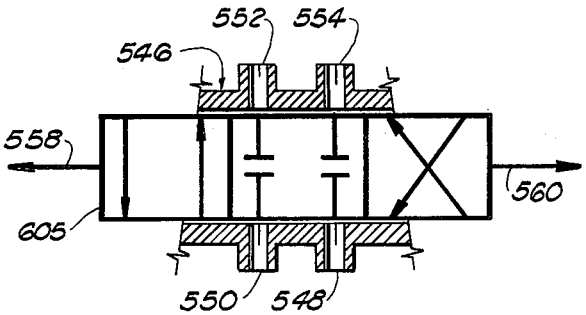

On the other hand, when the first fluid control means 605 is positioned in the second positional mode when the first pressure controlling mechanism 556 is moved in the second control direction 560 relative to the first valve body 546, and in this positional mode, the power fluid inlet 548 is in fluid communication with the second power fluid outlet 554, and the power fluid return 550 is in fluid communication with the first power fluid outlet 552. This positional mode is shown in the diagram of FIG. 13B. Of course, as will be understood by any person possessing ordinary skill in the hydraulic valving art, the conditions herebefore described are the extreme alternate conditions, and it is known to design porting mechanisms to vary the fluid routing proportionally to such positions if desired to transition the fluid routing gradually or rapidly in response to the differential position of the first pressure controlling mechanism 556 to the first valve body 546. Further, a null positional mode is provided, as shown in FIG. 13C, wherein all of the ports of the first valve body are blocked so that an equilibrium condition is attained.

Returning to FIG. 11, and a further description of the construction of the first hydraulic porting valve assembly 540, it should be noted that the first valve body 546 has a supporting arm 570 attached to one side of the first valve body 546. The supporting arm 570 has a pivot post 572 extending normal to the supporting arm 570 at the end 574 thereof. A shelf member 576 is attached to and extends from the rear plate 142 of the frame assembly 12, and a bearing cylinder 578 is attached thereto. The bearing cylinder 578 has a bore which receives the pivot post 572 for rotation therein. A conventional keeper means (not shown) is utilized to retain the pivot post 572 in the bearing cylinder 578. The supporting arm has an aperture 580, and a spring 582 has one end 584 hookingly engaged through the aperture 580 to the supporting arm 570. The other end 586 of the spring 582 is attached to the paving machine 10 at a convenient location, such as by hooking to the housing 178 that is attached to the rear plate 142. Another aperture 588 is also located in the supporting arm 570 in near proximity to the aperture 580 in the manner shown, and a first cable 590 has one of its ends 592 disposed through the aperture 588 to form looping attachment to the supporting arm 570, the first cable 590 providing means to oppose the spring 582 on the supporting arm 570. The spring 582 provides a biasing force that tends to move the supporting arm 570 (and consequently the first valve body 546) in the first valve body first direction 594. The first cable 590, as will become clear below, is utilized to exert a force in opposition to the force exerted by the spring 582, the first cable 590 when pulled causing the supporting arm 570 (and consequently the first valve body 546) to move in the first valve body second direction 596. The first cable 590 serves as a first feedback linkage means between the first valve body 546 and the swash plate control of a hydraulic power assembly.

The arrangement whereby the movement of the first valve body 546 is movable by the spring 582 and the first cable 590, and whereby the first pressure controlling mechanism 556 is movable by movement of the first paddle linkage rod 556, provides independent relative movement of the first valve body 546 to the first pressure controlling mechanism 556. The utilization of this independent relative movement in the present invention will be understood by further description while referring to FIG. 12. Also, as was discussed above, the construction detail and operation of the second hydraulic porting valve assembly 542 will become clear as FIG. 12 is described.

Figure 12:
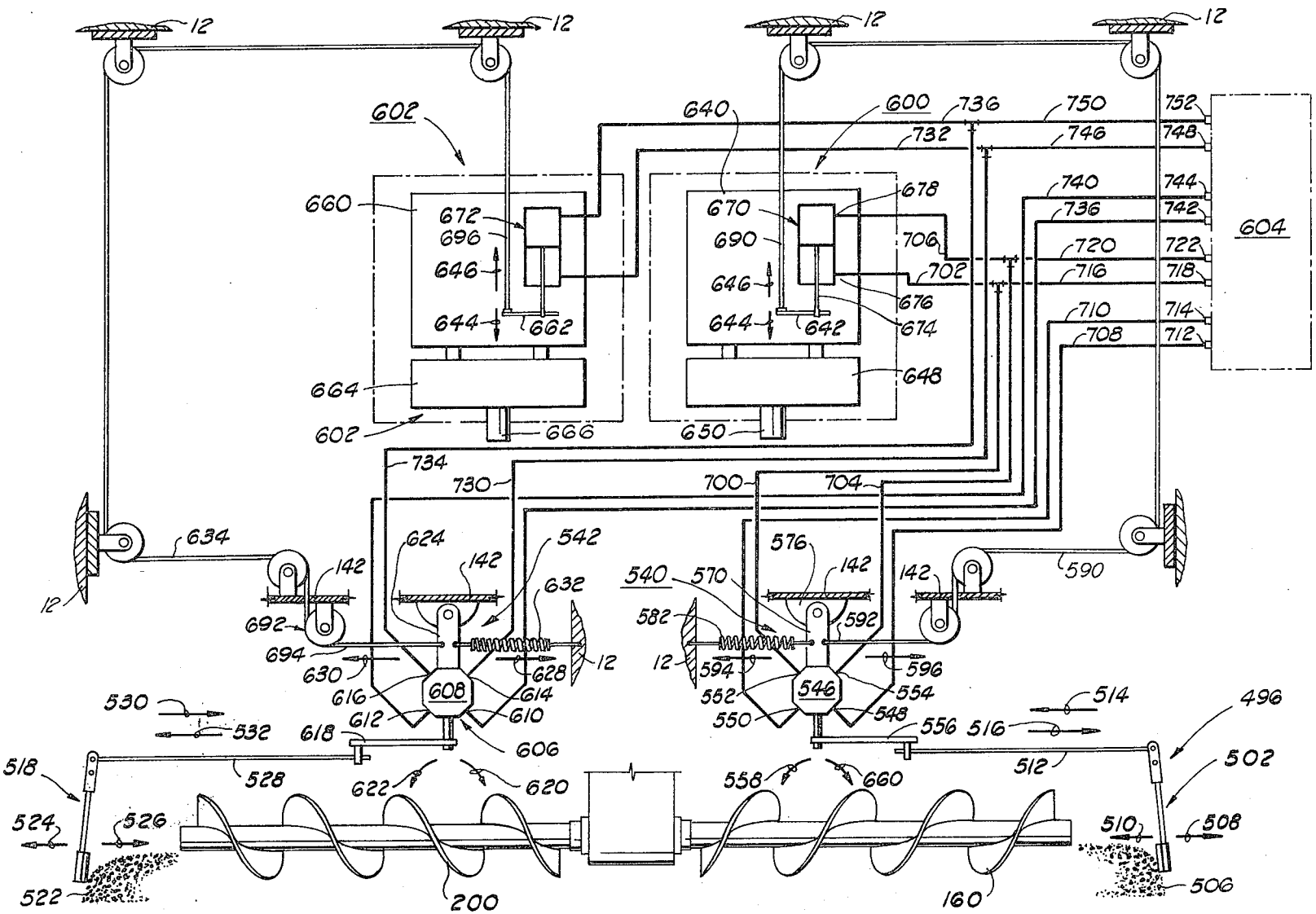
FIG. 12 is a diagrammatical depiction of the paving material feeder control mechanism of the present invention.

FIG. 12 is a diagrammatic depiction of the paving material feeder control mechanism of the present invention. The first hydraulic porting valve assembly 540 and the second hydraulic porting valve assembly 542 are shown in FIG. 12 and for the purpose of clarity, the above described operation of these assemblies will be briefly described with reference to FIG. 12. Also depicted in FIG. 12 are the first screw conveyor 160, the second screw conveyor 200, a first hydraulic power assembly 600, a second hydraulic power assembly 602, a hydraulic switching apparatus 604, and the first and second sensor means 496, 498, each of which will be more fully explained hereinbelow as to the interconnection and operation thereof.

The first linkage rod 512 connects between the first paddle member 502 and the first pressure controlling mechanism 556 for pivoting the first pressure control mechanism 556 relative to the first valve body 546 when the first paddle member 502 is pivoted in the first paddle direction 508 or in the second paddle direction 510. Another way of stating this is that the first paddle linkage rod 512 spatially establishes the position of the first pressure controlling mechanism 556 for a given position of the first paddle member 502. Since the first valve body 546 is movable by the spring 582 and the first cable 590, the relative position of the first pressure controlling mechanism 556 to the first valve body 546 is also changed by the movement of the first valve body 546 while the first pressure controlling mechanism 556 remains stationary. As will become clear, when the first fluid control means 605 of the first porting valve 544 has been placed in the first or second positional modes, a change of condition is signaled, and an appropriate response follows.

Figure 14A:
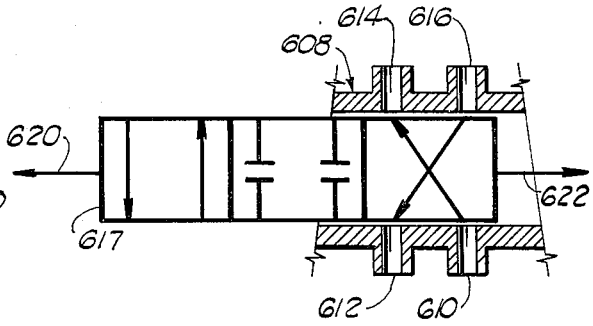
FIGS. 14A, 14B and 14C are diagrammatical depictions of the fluid communication positional modes of another hydraulic porting valve.
Figure 14B:
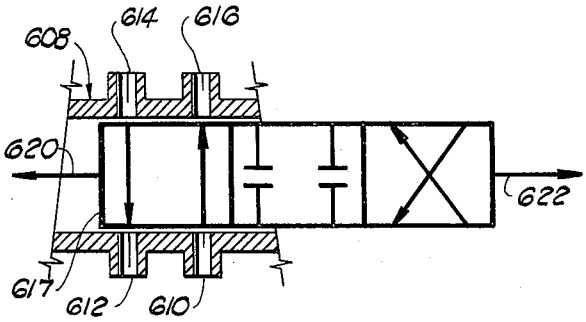
Figure 14C:
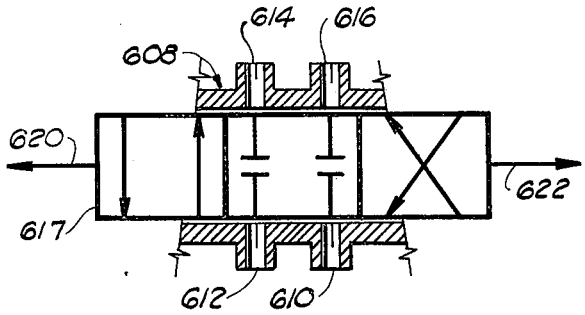

As now understandable by reference to FIG. 12, the second hydraulic porting valve assembly 542 has a second porting valve 606 having a second valve body 608, the second valve body 608 having a power fluid inlet 610, a power fluid return port 612, a first power fluid outlet 614, and a second power fluid outlet 616. Disposed within the second valve body 608 is a second fluid control means 617 that is positionable in response to a second pressure controlling mechanism 618 pivotally supported by the second valve body 608. The second fluid control means 617 operates in the manner described above for the first fluid control means, and is understandable by reference to FIGS. 14A and 14B. The second pressure control mechanism 618 is movable in a first control direction 620 and in a second control direction 622. When the second pressure control mechanism 618 is moved in the first control direction 620 relative to the second valve body 608, the second fluid control means 617 is positioned in a first positional mode wherein the power fluid inlets 610 has fluid communication with the first power fluid outlet 614, and the second power fluid outlet 616 has fluid communication with the power fluid return port 612 (FIG. 14A). On the other hand, when the second pressure control mechanism 618 is moved in the second control direction 622 relative to the second valve body 608, the second fluid control means 617 is positioned in the second positional mode wherein the power fluid inlet 610 has fluid communication with the second power fluid outlet 616, and the first power fluid outlet 614 has fluid communication with the power fluid return port 612 (FIG. 14B). The general statements above stated relative to the first porting valve 544 also apply to the second porting valve 606, and the second fluid control means 617 may have a null mode as depicted in FIG. 14C wherein all the ports of the second valve body 608 are blocked to pressure fluid flow.

Returning to FIG. 12, the second valve body 608 is pivotally supported via a supporting arm 624 on a shelf member 626 in the same type of pivoting connection as was described for the supporting arm 570 on the shelf member 576, the second valve body 608 being pivotal in a second valve body first direction 628 and in a second valve body direction 630. A spring 632 is connected to one side of the supporting arm 624, and a second cable 634 is connected to the other side of the supporting arm 624. The spring 632 biases the second valve body 608 to move in the second valve body first direction 628, and the second cable 634 counters the spring 632 by pulling the second valve body 608 in the second valve body second direction 630.

The second paddle linkage means 528 is connected between the second paddle member 518 and the second pressure controlling mechanism 618 to spatially position the second pressure controlling mechanism 618 in response to the position of the second paddle member 518, thus effectuating a relative movement between the second controlling mechanism 618 and the second valve body 608.

The first hydraulic power assembly 600 comprises a variable displacement first hydraulic pump 640 of conventional design that is controlled by a swash plate control lever 642. That is, the output of the first hydraulic pump 640 is determined by the engine speed and the tilt angle of the pump's swash plate. Engine speed is controlled by a throttle control (not shown), while the pump swash plate tilt angle is determined by the swash plate control lever 642. Since such mechanisms are known in the art, it is sufficient for the purpose herein to state that the swash plate control lever is movable in an output increase direction 644 or in an output decrease direction 646.

The first hydraulic power assembly 600 further comprises a first hydraulic motor 648 that has an output shaft 650 that is rotated by the operation of pressurized hydraulic fluid communicated to the first hydraulic pump 648 by the first hydraulic pump 640. It will be understood by persons skilled in the art of hydraulics that the output speed of the first hydraulic motor 648 is variable, being responsive to the positional setting of the swash plate control lever 642 that determines the output pressure of the first hydraulic pump 640. The engine power source for the first hydraulic pump is conventional in design and it is not necessary for the purposes of this disclosure to include a description thereof.

In like manner to that which has been described for the first hydraulic power assembly 600, the second hydraulic power assembly 602 comprises a variable displacement second hydraulic pump 660 of conventional design that is controlled by a swash plate control lever 662. The output of the second hydraulic pump 660 is determined by the engine speed and the tilt angle of the pump's swash plate. The speed of the engine that drives the second hydraulic pump 660 is controlled by a throttle control (not shown), while the pump swash plate tilt angle is determined by the swash plate control lever 662. Since such mechanisms are known in the art, it is sufficient for the purpose herein to state that the swash plate control lever 662 is movable in the output increase direction 644 or in the output decrease direction 646.

The second hydraulic power assembly 602 further comprises a second hydraulic motor 664 that has an output shaft 666 that is rotated by the operation of pressurized hydraulic fluid communicated to the second hydraulic motor 664 by the second hydraulic pump 660. As in the case of the first hydraulic power assembly 600, the output speed of the output shaft 666 of the second hydraulic motor 664 is variable, being responsive to the positional setting of the swash plate control lever 662 that determines the output pressure of the second hydraulic pump 660.

By means of conventional gearing mechanisms (not shown), the output shaft 650 of the first hydraulic motor 648 is drivingly connected to the first slat conveyor 100, and to the first screw conveyor 160. Therefore, the linear speed of the first slat conveyor 100 is directly proportional to the speed of the output shaft 650. Also, the rotational speed of the first screw conveyor 160 is proportional to the speed of the output shaft 650. It follows that the positional setting of the swash plate control lever 642, which determines the output pressure of the first hydraulic pump 640 and the speed of the output shaft 650 of the first hydraulic motor 648, directly controls the speed at which the first slat conveyor 100 and the first screw conveyor are operated.

In like manner to that which has been described for the first hydraulic power assembly 600, the second hydraulic power assembly 602 is also connected via conventional gearing mechanisms that are connected to the second output shaft 666 of the second hydraulic motor 664 in a driving relationship to the second slat conveyor 102 and to the second screw conveyor 200. Therefore, the linear speed of the second slat conveyor 102 is directly proportional to the speed of the second output shaft 666. Also, the rotational speed of the second screw conveyor 200 is proportional to the speed of the second output shaft 666. It follows that the positional setting of the swash plate control lever 662, which determines the output pressure of the second hydraulic pump 660 and the speed of the second output shaft 666 of the second hydraulic motor 660, directly controls the speed at which the second slat conveyor 102 and the second screw conveyor 200 are operated.

To control the positional settings of the swash plate control levers 642 and 662 of the first and second hydraulic pump 640 and 660 respectively, a first hydraulic ram 670 and a second hydraulic ram 672 are provided. The first hydraulic ram 670 is of the type having a double acting piston that is connected to an extendible connecting rod 674, the distal end of the extendible rod 674 being connected to the swash plate control lever 642 of the first hydraulic pump 640 so as to selectively move the swash plate control lever 642 upon extension or retraction of the first hydraulic ram 673. The first hydraulic ram 670 has a first power fluid inlet 676 and a second power fluid inlet 678, the first power fluid inlet 676 and the second power fluid inlet 678 being disposed to pressurize opposite sides of the double acting piston of the first hydraulic ram 670. When pressurized hydraulic fluid is communicated to the first pressure fluid inlet 676, and the second pressure fluid inlet 678 is simultaneously relieved, the extendible connecting rod 674 causes the swash plate control lever 642 to move in the output decrease direction 646. Alternately, when pressurized hydraulic fluid is communicated to the second pressure fluid inlet 678, and the first pressure fluid inlet 676 is simultaneously relieved, the extendible connecting rod 674 causes the swash plate control lever 642 to move in the output direction 644. It is clear that the extension or retraction of the first hydraulic ram 670 by way of the selective pressurization of the first pressure fluid inlet 676 or the second pressure fluid inlet 678 controllably positions the swash plate control lever 642, and consequently controls the speed of the first output shaft 650; therefore, the linear speed of the first slat conveyor 100 and the rotating speed of the first screw conveyor 160 is controlled by the selective pressurization of the first hydraulic ram 670.

In like manner to that of the first hydraulic ram 670, the second hydraulic ram 672 is of the type having a double acting piston that is connected to an extendible connecting rod 680, the distal end of the extendible connecting rod 680 being connected to the swash plate control 662 of the second hydraulic pump 660 so as to selectively move the swash plate control lever 662 upon extension or retraction of the second hydraulic ram 672. The second hydraulic ram 672 has a first power fluid inlet 682 and a second power fluid inlet 684, the first and second power fluid inlets 682 and 684 being disposed to pressurize opposite sides of the double acting piston of the second hydraulic ram 672. When pressurized hydraulic fluid is communicated to the first pressure fluid inlet 682, and the second pressure fluid inlet 684 is simultaneously relieved, the extendible connecting rod 680 causes the swash plate control lever 666 to move in the output decrease direction 646. Alternately, when pressurized hydraulic fluid is communicated to the second pressure fluid inlet 684, and the first pressure fluid inlet 682 is simultaneously relieved, the extendible connecting rod 680 causes the squash plate control lever 662 to move in the output increase direction 644. It is clear that the extension and retraction of the first hydraulic ram 670 by way of the selective pressurization of the first pressure fluid inlet 682 or the second pressure fluid inlet 684 controllably positions the swash plate control lever 662 and consequently controls the speed of the second output shaft 666; therefore, the linear speed of the second slat conveyor 102 and the rotating speed of the second screw conveyor 200 is controlled by the selective pressurization of the second hydraulic ram 672.

Following the above description of the components depicted in FIG. 12, a description of the layout and interconnection of these components will now be undertaken. As shown in FIG. 12, the first cable 590 has one end 592 connected to the supporting arm 570 and the other end 690 is connected to the swash plate control lever 642. A number of pulleys 692, supported appropriately by the frame assembly 12, are disposed in supporting relation to the cable 590. Movement of the swash plate control lever 642 in the output increase direction 644 causes the first cable 590 to exert a pulling force on the supporting arm 570, whereupon, the first valve body 546 is pivoted in the first valve body second direction 596 against the countering force of the spring 582. When the swash plate control lever 642 is caused to move in the output decrease direction 642, the first cable 950 is slackened, and the spring 582 causes the first valve body 546 to be moved in the first valve body first direction 594, thereupon taking up any slack in the first cable 590.

In like manner, the end 694 of the second cable 634 is connected to the supporting arm 624 that holds the valve body 608, and the other end 696 of the cable 634 is connected to the swash plate control lever 662 of the second hydraulic pump 660. A number of pulleys 692, supported appropriately by the frame assembly 12, are disposed in supporting relation to the cable 634. Movement of the swash plate control lever 662 in the output increase direction 644 causes the second cable 634 to exert a pulling force on the supporting arm 624, whereupon the second valve body 608 is pivoted and the second valve body second direction 630 against the countering force of the spring 632 connected to the supporting arm 624. When the swash plate control lever 662 is caused to move in the output decrease direction 642, the second cable 634 is slackened, and the spring 632 causes the second valve body 608 to be moved in the second valve body first direction 628, thereupon taking up any slack in the second cable 634.

The above described arrangement for the first cable 590 that interconnects the swash plate control lever 642 and the first valve body 508, and the spring 592, provide a first feedback linkage means; and, the second cable 634 that interconnects the swash plate control lever 662 and the second valve body 608, and the spring 632, provide a second feedback linkage means. These first and second feedback linkage means respectively move the first and second valve bodies 508, 608 in response to the movements of the swash plate control levers 642, 662. This arrangement, in conjunction with the previously described first and second fluid control means 605, 617 that are respectively positionable in response to the first and second paddle members 502, 518, serves to proportion the rate of material transfer as required to maintain the outer ends 506, 522 of the paving material mound 500 at predetermined locations. Of course, conduit means properly connect the first and second four-way hydraulic porting valves 544 and 606 in selective fluid communication with the first and second hydraulic pumps 640 and 660 respectively as follows.

The conduits 700 and 702 connect the first power fluid outlet 552 of the first valve body 508 and the first power fluid inlet 676 of the first hydraulic ram 670. The conduits 704 and 706 connect the second power fluid outlet 552 of the first valve body 508 and the second power fluid inlet 554 of the first hydraulic ram 670. A conduit 708 and a conduit 710 connect the power fluid inlet 548 and the power fluid return port 550 to the ports 712 and 714 respectively of the hydraulic switching apparatus 604. A conduit 716 connects the conduits 700 and 702 to the port 718 of the hydraulic switching apparatus 604. A conduit 720 connects the conduits 704 and 706 to the hydraulic switching apparatus 604 at the port 722.

In brief comment thereto, the hydraulic switching apparatus 604 is a conventional hydraulic switching apparatus that need nto be described in detail herein for the purposes of this disclosure, for the reason that it is well known to connect the hydraulic switching apparatus 604 to a source of pressurized hydraulic fluid, and to provide start up and shutdown switches appropriately fitted with back flow valves to make the illustrated and described hydraulic circuitry of FIG. 12 operate in the manner proposed, and additionally to provide the normal starting and stopping capability that is normally desirable for a paving machine.

In a similar manner to that for the above described conduits, the conduits 730 and 732 connect the first power fluid outlet 614 of the second valve body 608 and the first power fluid inlet 682 of the second hydraulic ram 672. The conduits 734 and 736 connect the second power fluid outlet 616 of the second valve body 608 and the second power fluid inlet 684 of the second hydraulic ram 672. A conduit 738 and a conduit 740 connect the power fluid inlet 610 and the power fluid return port 612 respectively to the ports 742 and 744 of the hydraulic switching apparatus 604. A conduit 746 connects the conduits 730 and 732 to the port 748 of the hydraulic switching apparatus 604. A conduit 750 connects the conduits 734 and 736 to the port 752 of the hydraulic switching apparatus 604.

To understand the operation of the material transfer mechanism depicted in FIG. 12, it is perhaps best to once again start with the first paddle member 502 and follow through the activity created by change in positioning thereof. As has been noted hereinabove, the first paddle member 502 senses the location of the outer end 506 of the paving material mound 500. As the paving material mound 500 is formed by the transfer of paving material as is performed by the cooperative functions of the first slat conveyor 100 and the first spreader means (screw conveyor) 160, more or less paving material will be required to maintain the outer end 506 at a predetermined location. The first paddle member 502 is set at a predetermined or desired position, and it follows that this causes the first paddle linkage rod 512 to position the first pressure controlling mechanism 556 to establish the first fluid control means 605 in the null positional mode as shown in FIG. 13C. At this predetermined setting of the first hydraulic porting valve 544, the first power fluid outlet 552 and the second power fluid outlet 554 are blocked to external fluid communication, and the setting of the first hydraulic ram 670 remains constant; consequently the output speeds of the output shaft 650 is set as are the speeds of the first slat conveyor and the first screw conveyor 160. If the first paddle member 502 senses a changed position of the outer end 506 of the paving material mound 500, the first paddle member 502 will move in either the first paddle direction 508 or in the second paddle direction 510, and a changed condition is signaled via the first paddle linkage rod 512 and the first pressure controlling mechanism 556, the result of which is a change of setting of the first fluid control means 605. For example, when the first paddle member 502 is moved in the first paddle direction 508, the first paddle linkage rod 512 is moved in the first rod direction 514, thereby rotating the first pressure controlling mechanism 556 in the first control direction 558. This in turn causes the first fluid control means 605 to move into the first positional mode as shown in FIG. 13A. When the first fluid control means 605 is in the first positional mode, the power fluid inlet 548 has fluid communication with the first power fluid outlet 552, permitting pressure fluid to exert force via the conduits 700, 702 and the first power fluid inlet 676 to the first hydraulic ram 670 to retract the extendible connecting rod 674, the conduits 704, 706 being simultaneously pressure relieved through the second power fluid outlet 554, the power fluid return port 550, and the conduit 710. The retraction of the extendible connecting rod 674 moves the swash plate control lever 642 in the output decrease direction 646, thereby slackening the first cable 590, the result of which is the movement of the first valve body 546 in the first valve body first direction 594 via the action of the spring 582 exerting force on the supporting arm 570 to take up the slack permitted in the first cable 590 by the movement of the swash plate control lever 642. Thus, the first valve body 546 moves directly with a movement of the swash plate control lever 642. The movement of the first valve body 546 is relative to that of the first fluid control means 605, thereby balancing the first porting valve 544, or that is, causes the first valve body 546 to move in a manner that places the first fluid control means 605 in the null positional mode (FIG. 13C). As the swash plate control lever 642 is moved in the direction 646, the rotational speed of the output shaft 650 is reduced in proportion to the amount of movement of the swash plate control lever 642, because the output pressure of the first hydraulic pump 640 that drives the first hydraulic motor 648 is reduced. As the speed of the output shaft 650 is reduced, the first slat conveyor 100 and the first screw conveyor 160 are slowed, and less paving material is delivered thereby to form the paving material mound 500. This, of course, causes the outer end 506 of the paving material mound 500 to move in a direction that allows the first paving member 502 to be turned towards its predetermined setting.

If, on the other hand, the first paddle member 502 moves in the second paddle direction 510, the first paddle linkage rod 512 causes the first pressure controlling mechanism 556 to pivot in the second control direction 560, thereby moving the first fluid control means 605 into the second positional mode relative to the first valve body 546, as shown in FIG. 13B. When the fluid control means is in the second positional mode, the second power fluid outlet has fluid communication with the power fluid inlet 548, thereby pressurizing the first hydraulic ram 670 via the conduits 704, 706 and the second power fluid inlet 678, the conduits 700, 702 being simultaneously relieved through the first power fluid outlet 552, the power fluid return port 550, and the conduit 710. This condition effectuates the extension of the extendible connecting rod 674 which causes the swash plate control lever 642 to move in the output increase direction 644, the result of which simultaneously increases the speed of the output shaft 650 and pulls the first cable 590. The force exerted on the first cable 590 moves the first valve body 546 in the first valve body second direction 596. As a result of the increased speed of the output shaft 650, more paving material is delivered by the consequent increased speed of the first slat conveyor 100 and the first screw conveyor 160. As a result of the movement of the first valve body 546 by the cable 590, the first valve body 546 moves relative to the first fluid control means 605 so that the first porting valve 544 assumes the null position (FIG. 13C), and the output delivery rate of the first slat conveyor 100 and the first screw conveyor 160 is established at a higher paving material delivery and spreading rate.

It is clear that the first paddle end 507 is positioned to follow the movement of the outer end 506, and that the deviation of the first paddle end 507 from a predetermined position is sensed via the mechanism above described. When the amount of the paving material delivered and spread by the first slat conveyor 100 and the first screw conveyor 160 form the paving material mound 500 in a manner sufficient to stabilize the position of the first paddle member 502, an equilibrium condition is established, this equilibrium condition being defined as: the first fluid control means 605 is in a null position relative to the first valve body 546 (FIG. 13C); the first hydraulic ram 670 is in a stationary setting; and the output shaft 650 is being rotated at a speed that drives the first slat conveyor 100 and the first screw conveyor 160 (for a given setting of the gate panel 122) sufficient to deliver a quantity of paving material as required to stabilize the position of the outer end 506 of the paving material mound 500. When a change of the outer end 506 is signaled (due to a change in paving material requirement), a new delivery rate of paving material is effectuated by the sensing of the requirement by the first paddle member 502, and an increase or decrease in the paving material delivery rate is effectuated as described above. This new delivery rate is tested as to its effectiveness to re-establish equilibrium by the effect that the new delivery rate makes in the positioning of the outer end 506. In practice, this is a dynamic activity, the rate of delivery of paving material being changed to satisfy the demand of repositioning the first paddle member 502 and the consequent nulling of the first four-way porting valve 544. It is known to provide flow restrictions in the conduits to alter the response time of the system, and to obtain a desired rate of reaction.

It will be understood that the operation of the second paddle member 518 with the second hydraulic power assembly 602 and the second hydraulic porting valve assembly 542 is identical to that which has been described above, and further discussion thereof will not be necessary for the purpose of disclosure herein. It is sufficient to note that the speed of the output shaft 666, which drives the second slat conveyor 102 and the second screw conveyor 200, is changed proportionally to the movement of the second paddle member 518, the second paddle linkage rod 528, the second hydraulic porting valve assembly 542, and the second hydraulic power assembly 602.

Various details of construction of paving machines which are generally known in the prior art have been omitted from the present disclosure in order that this disclosure may be presented with clarity. It will be understood that many such details are design choices and will vary according to particular job specifications and requirements.

It will be clear that the present invention presents an improved material transfer mechanism that is responsive to a detected controlled dimension parameter (that is, the location of the outer ends 506, 522 of the paving material mound 500); that the present invention is capable of operating in a rugged environment as evident from the use of mechanical components which comprise the system; and the the present invention provides an efficient transfer mechanism which is easily manufacturable, has extended life usefulness, and require a minimum of maintenance.

Changes may be made in the various components and the interconnecting thereof as described in the disclosure of the preferred embodiment, without departing from the spirit and scope of the present invention.

What is claimed is:

1. In combination with a road building machine, the improvement comprising:

a first hydraulic power assembly mounted on the machine, having a swash plate control and a first hydraulic motor, the output speed of the first hydraulic motor being variable and responsive to the positional setting of the swash plate control;

a first hydraulic ram having a double acting piston connected to an extendible connecting rod, the connecting rod attached to the swash plate control of the first hydraulic power assembly and selectively moving the swash plate control upon extension or contraction of the connecting rod, the first hydraulic ram having a first power fluid inlet and a second power fluid inlet;

a first hydraulic porting valve assembly characterized as comprising:

a first valve body movably supported by the road building machine, the first valve body having a power fluid inlet, a first power fluid outlet, and a second power fluid outlet;

a first pressure controlling mechanism connected to the first valve body; and first fluid control means disposed in the first valve body and positionable in response to the movement of the first pressure controlling mechanism, the first fluid control means positionable in a first positional mode by the movement of the first pressure controlling mechanism in a first control direction relative to the first valve body, the power fluid inlet in fluid communication with the first power fluid outlet in the first positional mode, and the first fluid control means positionable in a second positional mode by movement of the first pressure controlling mechanism in a second control direction relative to the first valve body, the power fluid inlet in fluid communication with the second power fluid outlet in the second positional mode;

conduit means connecting the first hydraulic porting valve and the first hydraulic ram for providing fluid communication between the first power fluid outlet of the first valve body and the first power fluid inlet of the first hydraulic ram;

conduit means connecting the first hydraulic porting valve and the first hydraulic ram for providing fluid communication between the second power fluid outlet of the first valve body and the second power fluid inlet of the first hydraulic ram;

first feedback linkage means connecting the first valve body and the swash plate control of the first hydraulic power assembly for moving the first valve body, responsive to the movement of the swash plate control, in a first valve body first direction and, alternately, in a first valve body second direction, the first valve body second direction being generally opposite to the first valve body first direction; and first sensor means connected to the first pressure controlling mechanism for moving said mechanism in response to a detected control dimension parameter.

2. The combination of claim 1 wherein the first feedback linkage means is further characterized as comprising a first biasing means for biasing the first valve body to move in the first valve body first direction.

3. The combination of claim 2 wherein the first biasing means is characterized as comprising a spring having one end connected to the first valve body and the road building machine is further characterized as comprising a frame assembly, the other end of the spring being connected to the frame assembly.

4. The combination of claim 3 wherein the first feedback linkage means is further characterized as comprising a cable connected at one end to the swash plate control of the first hydraulic power assembly and the other end thereof connected to the first valve body, whereby the first valve body is movable in the first valve body second direction.

5. The combination of claim 4 wherein the road building machine is a surface finishing machine for the continuous laying of a paving material on a roadway, and further comprising:

a frame assembly, the first hydraulic motor being supported thereon;

drive means supporting the frame assembly for moving the frame assembly in a driven direction over the roadway;

hopper means on the frame assembly for receiving the paving material;

first spreader means on said frame assembly for distributing the paving material transversely to the driven direction on the roadway;

first transfer means on said frame assembly for transferring the paving material from the hopper means to the first spreader means;

screed means pivotally attached to said frame assembly for compressing the paving means spread by the first spreader means; and the first sensor means is characterized as comprising:

a first paddle member pivotally mounted on the frame assembly and having a paddle end contactingly engagable and movable by the paving material spread on the roadway by the first spreader means in a first paddle direction;

biasing means for biasing the paddle end of the first paddle member to move in a second paddle direction, the second paddle direction being generally opposite to the first paddle direction; and paddle linkage means connecting the first paddle member and the first pressure controlling mechanism for moving the first pressure controlling mechanism responsive to the movement of the first paddle member.

6. The combination of claim 5 wherein the first spreader means is characterized as comprising:

a first screw conveyor supported by the frame assembly a determined distance over the roadway transversely to the driven direction; and connecting means connecting the first screw conveyor and the first hydraulic motor for drivingly rotating the first screw conveyor.

7. The combination of claim 6 wherein the first transfer means is characterized as comprising:

a first slat conveyor supported by the frame having a first end portion positioned in paving material receiving relation to the hopper means and a second end portion positioned in paving material dispensing relation to the first screw conveyor; and, connecting means connecting the first slat conveyor and the first hydraulic motor for driving the first slat conveyor whereby paving material is transferred from the hopper means to the first screw conveyor.

8. The combination of claim 7 wherein the hopper means is characterized as comprising:

a first hopper member pivotally supported by the frame, the first hopper member having a material receiving positional mode and a material dumping positional mode;

a second hopper member pivotally supported by the frame, the second hopper member having a material receiving positional mode and a material dumping positional mode, the first hopper member and the second hopper member forming a material receiving cavity; and positioning means connected between each hopper member and the frame assembly for positioning the first hopper member and the second hopper member in the material receiving positional mode and alternately in the material dumping positional mode.

9. The combination of claim 8 wherein the drive means is characterized as comprising:

a front suspension and steering assembly comprising:

a cross trunnion member having a first end and a second end extending transverse to the frame and pivotally supported at its midpoint for pivotation of the first end and the second end toward and away from the roadway;

a first bogie member pivotally mounted on the first end of the cross trunnion member;

a first pair of wheels supported in tandem relationship near the ends of the first bogie member, each of the wheels of the first pair of wheels mounted for pivotation relative to the first bogie member about an axis extending generally normal to the roadway;

hydraulic ram means interconnecting the first pair of wheels for selectively pivoting the wheels of the first pair of wheels in unison about the respective normal axes of pivotation;

a second bogie member pivotally mounted on the second end of the cross trunnion member;

a second pair of wheels supported in tandem relationship near the ends of the second bogie member, each of the wheels of the second pair of wheels mounted for pivotation relative to the second bogie member about a normal axis of pivotation extending generally normal to the roadway;

connecting means interconnecting the second pair of wheels for effectuating the wheels of the second pair of wheels to pivot in unison about the respective normal axes of pivotation; and, tie bar means interconnecting the first pair of wheels and the second pair of wheels whereby the pivotation of the first pair of wheels causes a responsive pivotation of the second pair of wheels for steering the machine along a determined path; and, rear wheel means cooperatively with the first pair and second pair of wheels, supporting the frame.

10. The combination of claim 9 wherein the screed means is further characterized as comprising:

a screed member;

a first pulling arm connected to one side of the screed member;

a second pulling arm connected to the other side of the screed member, the first and second pulling arms being generally parallel to each other and disposed on either side of the frame, the distal ends of the first and second pulling arms being tow point connection portions respectively of each arm;

adjustable connecting means connecting the first pulling arm at the tow point connection portion thereof to one side of the frame and connecting the second pulling arm at the tow point connection portion thereof to the other side of the frame at the respective tow point portions thereof, whereby the screed member is pulled behind the frame over the paving material spread by the first screw conveyor when the frame is moved in the driven direction.

11. The combination of claim 10 further characterized as comprising:

a second hydraulic power assembly having a swash plate control and a second hydraulic motor, the output speed of the first hydraulic motor being variable and responsive to the positional setting of the swash plate control;

a second hydraulic ram having a double acting piston connected to an extendible connecting rod, the connecting rod attached to the swash plate control of the first hydraulic power assembly and selectively moving the swash plate control upon extension or contraction of the connecting rod, the second hydraulic ram having a first power fluid inlet and a second power fluid inlet;

a second hydraulic porting valve assembly characterized as comprising:

a second valve body movably supported by the road building machine, the second valve body having a power fluid inlet, a first power fluid outlet, and a second power fluid outlet;

a second pressure controlling mechanism connected to the second valve body; and second fluid control means disposed in the second valve body and positionable in response to the movement of the second pressure controlling mechanism, the second fluid control means positionable in a first positional mode by the movement of the second pressure controlling mechanism in a first control direction relative to the second valve body, the power fluid inlet in fluid communication with the second power fluid outlet in the first positional mode, and the second fluid control means positionable in a second positional mode by movement of the second pressure controlling mechanism in a second control direction relative to the second valve body, the power fluid inlet in fluid communication with the second power fluid outlet in the second positional mode;

conduit means connecting the second valve body and the second hydraulic ram for providing fluid communication between the second power fluid outlet of the second valve body and the first power fluid inlet of the second hydraulic ram;

conduit means connecting the second valve body and the second hydraulic ram for providing fluid communication between the second power fluid outlet of the second valve body and the second power fluid inlet of the second hydraulic ram;

second feedback linkage means connecting the second valve body and the swash plate control of the second hydraulic power assembly for moving the second valve body, responsive to the movement of the swash plate control, in a second valve body first direction and, alternately, in a second valve body second direction, the second valve body second direction being generally opposite to the second valve body first direction; and second sensor means connected to the second pressure controlling mechanism for moving said mechanism in response to a detected control dimension parameter.

12. The combination of claim 11 wherein the second feedback linkage means is further characterized as comprising a second biasing means for biasing the second valve body to move in the second valve body first direction.

13. the combination of claim 12 wherein the second biasing means is characterized as comprising a spring having one end connected to the second valve body, the other end of the spring being connected to the frame assembly.

14. The combination of claim 13 wherein the second feedback linkage means is further characterized as comprising a cable connected at one end to the swash plate control of the second hydraulic power assembly and the other end thereof connected to the second valve body, whereby the second valve body is movable in the second valve body second direction.

15. The combination of claim 14 further comprising:

second spreader means mounted on the frame assembly for distributing the paving material transversely to the driven direction; and second transfer means between the hopper means and the second spreader means for transferring the paving material from the hopper means to the second spreader means; and the second sensor means is characterized as comprising:

a second paddle member pivotally mounted on the frame and having a distal end contactingly engagable and movable by the paving material spread of the roadway surface by the second spreader means in a first paddle direction;

biasing means for biasing the distal end of the second paddle member to move in a second paddle direction, the second paddle direction being generally opposite to the first paddle direction; and paddle linkage means connecting the second paddle member and the second pressure controlling mechanism for moving the second pressure controlling mechanism responsive to the movement of the second paddle member.

16. The combination of claim 15 wherein the second spreader means is characterized as comprising:

a second screw conveyor supported by the frame a determined distance over the roadway transversely to the driven direction and aligned axially with the first screw conveyor; and connecting means connecting the second screw conveyor and the second hydraulic motor for drivingly rotating the second screw conveyor.

17. The combination of claim 16 wherein the second transfer means is characterized as comprising:

a second slat conveyor supported by the frame having a first end portion positioned in paving material receiving relation to the hopper means and a second end portion positoned in paving material dispensing relation to the second screw conveyor; and connecting means connecting the second slat conveyor and the second hydraulic motor for driving the second slat conveyor whereby paving material is transferred from the hopper means to the second screw conveyor.

18. The combination of claim 17 wherein the positioning means is characterized as comprising:

a first hydraulic ram having one end connected to the frame and the other end connected to the first hopper member, the first hydraulic ram having a contracted mode wherein the first hopper member is pivoted thereby to be positioned in the material receiving positional mode, and an extended mode wherein the first hopper member is pivoted thereby to be in the material dumping positional mode;

a second hydraulic ram having one end connected to the frame and the other end connected to the second hopper member, the second hydraulic ram having a contracted mode wherein the second hopper member is pivoted thereby to be positioned in the material receiving positional mode, and an extended mode wherein the second hopper member is pivoted thereby to be in the material dumping positional mode; and switching means for selectively actuating the first and second hydraulic rams to the contracted mode and alternately, to the extended mode.

19. An improved surface finishing machine for the continuous paving of a paved lane on a roadway with paving material, comprising:

a frame assembly;

drive means supporting the frame assembly for moving the frame assembly along the roadway in a driven direction;

hopper means supported on said frame assembly for receiving the paving material;

first transfer means between hopper means and first spreader means for transferring the paving material from the hopper means to the first spreader means;

first spreader means supported on the frame assembly for distributing the paving material transversely to the direction of travel of the surface finishing machine;

screed means pivotally attached to the frame assembly for compressing the paving means spread by the spreader means; and a first feeder control assembly comprising:

a first hydraulic porting valve pivotably mounted on the frame assembly for pivotation in a first pivotal direction and in a second pivotal direction, the first hydraulic porting valve having a valve body and a controlling mechanism connected to the valve body and variably positionable relative thereto, the first hydraulic porting valve having a first output pressure mode and alternately, a second output pressure mode, responsively determined by the position of the controlling mechanism;

first biasing means biasing the first hydraulic porting valve to pivot in the first pivotal direction;

first sensor means contactingly engaging the paving material for detecting the paving material distributed by the first spreader means near one side of the paved lane and responsively moving the controlling mechanism of the first hydraulic porting valve to effectuate the first output pressure mode, and alternately, responsively moving the controlling mechanism of the first hydraulic porting valve to effectuate the second output pressure mode;

a first hydraulic power assembly having a swash plate control and a first hydraulic motor, the output speed of the first hydraulic motor being variable and responsive to the positional setting of the swash plate control;

a first hydraulic ram having an extendible connecting rod, the connecting rod attached to the swash plate control of the first hydraulic power assembly to selectively move the swash plate control upon extension or contraction of the connectng rod;

means connecting the first hydraulic ram and the first hydraulic porting valve for extending the connecting rod when the first hydraulic porting valve is in the first output pressure mode, and for contracting the connecting rod when the first hydraulic porting valve is in the second output pressure mode; and a first feedback linkage means connecting the first hydraulic porting valve and the swash plate control lever for moving the first hydraulic porting valve in response to movement of the swash plate control lever of the first hydraulic motor.

20. The surface finishing machine of claim 19 wherein the first feedback linkage means is characterized as comprising a cable connected at one end to the swash plate control of the first hydraulic power assembly and the other end thereof connected to the first hydraulic porting valve, whereby the first hydraulic porting valve is moved in a second pivotal direction, the second pivotal direction being generally opposite to the first pivotal direction.

21. The surface finishing machine of claim 20 wherein the first sensor means is characterized as comprising:

a first paddle member pivotally mounted on the frame and having a distal end contactingly engagable and movable by the paving material spread on the roadway surface by the first spreader means in a first paddle direction;

biasing means for biasing the distal end of the first paddle member to move in a second paddle direction, the second paddle direction being generally opposite to the first paddle direction; and paddle linkage means connecting the first paddle member and the controlling mechanism of the first hydraulic porting valve for moving the controlling mechanism responsive to the movement of the first paddle member.

22. The surface finishing machine of claim 21 wherein the first spreader means is characterized as comprising:

a first screw conveyor supported by the frame assembly a determined distance over the roadway transversely to the driven direction; and connecting means connecting the first screw conveyor and the first hydraulic motor for drivingly rotating the first screw conveyor.

23. The surface furnishing machine of claim 22 wherein the first transfer means is characterized as comprising:

a first slat conveyor supported by the frame assembly having a first end portion positioned in paving material receiving relation to the hopper means and a second end portion positioned in dispensing relation to the first screw conveyor; and connecting means connecting the first slat conveyor and the first hydraulic motor for driving the first screw conveyor whereby paving material is transferred from the hopper means to the first screw conveyor.

24. The surface finishing machine of claim 23 wherein the hopper means is characterized as comprising:

a first hopper member pivotally supported by the frame assembly, the first hopper member having a material receiving positional mode and a material dumping positional mode;

a second hopper member pivotally supported by the frame assembly, the second hopper member having a material receiving positional mode and a material dumping positional mode, the first hopper member and the second hopper member forming a material receiving cavity when in the material receiving positional mode;

positioning means connected between each hopper member and the frame assembly for positioning the first hopper member and the second hopper member in the material receiving positional mode, and alternately, for positioning the first hopper member and the second hopper member in the material dumping positional mode.

25. The surface finishing machine of claim 24 wherein the drive means is characterized as comprising:

a front suspension and steering assembly comprising:

a cross trunnion member having a first end and a second end extending transverse to the frame assembly and pivotally supported at its midpoint for pivotation of the first end and the second end toward and away from the roadway;

a first bogie member pivotally mounted on the first end of the cross trunnion member;

a first pair of wheels supported in tandem relationship near the ends of the first bogie member, each of the wheels of the first pair of wheels mounted for pivoting relative to the first bogie about a normal axis of pivotation extending generally normal to the roadway;

hydraulic ram means interconnecting the first pair of wheels for selectively pivoting the wheels of the first pair of wheels in unison about the respective normal axes of pivotation;

a second bogie member pivotally mounted on the second end of the cross trunnion member;

a second pair of wheels supported in tandem relationship near the ends of the second bogie member, each of the wheels of the second pair of wheels mounted for pivotation relative to the second bogie member about a normal axis of pivotation extending generally normal to the roadway;

connecting means interconnecting the second pair of wheels for effectuating the wheels of the second pair of wheels to pivot in unison about the respective normal axes of pivotation; and tie bar means interconnecting the first pair of wheels and the second pair of wheels so that the pivotation of the first pair of wheels causes a responsive pivotation of the second pair of wheels for steering the machine along a determined path; and rear wheel means cooperatively with the first pair and second pair of wheels supporting the frame.

26. The surface finishing machine of claim 25 wherein the screed means is further characterized as comprising:

a screed member;

a first pulling arm connected to one side of the screed member and extending upwardly away from the screed member;

a second pulling arm connected to the other side of the screed member and extending upwardly away from the screed member, the first and second pulling arms being generally parallel to each other and extending forward on either side of the frame assembly, the distal ends of the first and second pulling arms being tow point portions respectively of each arm; and adjustable connecting means connecting the first pulling arm to one side of the frame assembly and connecting the second pulling arm to the other side of the frame assembly at the respective tow point portions thereof, whereby the screed member is pulled behind the frame assembly over the paving material spread by the first screw conveyor when the frame assembly is moved in the driven direction.

27. The combination of claim 26 wherein the first biasing means is a spring having one end connected to the first hydraulic porting valve and the other end connected to the frame assembly.

28. The surface finishing machine of claim 27 further characterized as comprising:

second spreader means mounted on the frame assembly for distributing the paving material transversely to the direction of travel of the surface finishing machine;

second transfer means connecting the hopper means and the second spreader means for transferring the paving material from the hopper means to the second spreader means; and a second feeder control assembly comprising:

a second hydraulic porting valve pivotally mounted on the frame assembly for pivotation in a first pivotal direction and in a second pivotal direction the second hydraulic porting valve having a valve body and a controlling mechanism connected to the valve body and variably positionable relative thereto, the second hydraulic porting valve having a first output pressure mode, and alternately, a second output pressure mode, responsively determined by the position of the controlling mechanism;

second biasing means biasing the second hydraulic porting valve to pivot in the second pivotal direction;

second sensor means contactingly engaging the paving material for detecting the paving material distributed by the second spreader means near one side of the paved lane and responsively moving the controlling mechanism of the second hydraulic porting valve to effectuate the first output pressure mode and alternately, responsively moving the controlling mechanism of the second hydraulic porting valve to effectuate the second output pressure mode;

a second hydraulic power assembly having a swash plate control, and a second hydraulic motor, the output speed of the second hydraulic motor being variable and responsive to the positional setting of of the swash plate control;

a second hydraulic ram having an extendible connecting rod, the connecting rod attached to the swash plate control of the second hydraulic motor to selectively move the swash plate control upon extension or contraction of the connecting rod;

means connecting the second hydraulic ram and the second hydraulic porting valve for extending the connecting rod when the second hydraulic porting valve is in the first output pressure mode, and for contracting the connecting rod when the second hydraulic porting valve is in the second output pressure mode; and a second feedback linkage means for moving the second hydraulic porting valve in response to movement of the swash plate control of the second hydraulic motor.

29. The surface finishing machine of claim 28 wherein the second feedback linkage means is characterized as comprising a cable connected at one end to the swash plate control of the second hydraulic motor and the other end thereof connected to the second hydraulic porting valve, whereby the second hydraulic porting valve is moved in a first pivotal direction, the first pivotal direction being generally opposite to the second pivotal direction.

30. The surface finishing machine of claim 29 wherein the second sensor means is characterized as comprising:

a second paddle member pivotally mounted on the frame and having a distal end contactingly engagable and movable by the paving material spread on the roadway surface by the first spreader means in a first paddle direction;

biasing means for biasing the distal end of the second paddle member to move in a second paddle direction, the second paddle direction being generally opposite to the first paddle direction; and paddle linkage means connecting the first paddle member and the controlling mechanism of the second hydraulic porting valve for moving the controlling mechanism responsive to the movement of the second paddle member.

31. The surface finishing machine of claim 30 wherein the second spreader means is characterized as comprising:

a second screw conveyor supported by the frame assembly a determined distance over the roadway transversely to the driven direction and aligned with the first screw conveyor; and, connecting means connecting the second screw conveyor and the second hydraulic motor for drivingly rotating the second screw conveyor.

32. The surface finishing machine of claim 31 wherein the second transfer means is characterized as comprising:

a second slat conveyor supported by the frame assembly having a first end portion positioned in paving material receiving relation to the hopper means and a second end portion positioned in dispensing relation to the second screw conveyor; and connecting means connecting the second slat conveyor and the second hydraulic motor for driving the second slat conveyor whereby paving material is transferred from the hopper means to the second screw conveyor.

* * * * *